US009081347B2

(12) United States Patent
Fujimori et al.

(10) Patent No.: US 9,081,347 B2
(45) Date of Patent: Jul. 14, 2015

(54) LUBRICANT SUPPLYING DEVICE, IMAGE FORMING APPARATUS, AND PROCESS CARTRIDGE

(71) Applicants: Akira Fujimori, Kanagawa (JP); Satoshi Hatori, Kanagawa (JP); Naohiro Kumagai, Kanagawa (JP); Kaoru Yoshino, Tokyo (JP); Hideyasu Seki, Chiba (JP); Ryohta Gotoh, Tokyo (JP); Takeshi Shintani, Kanagawa (JP); Nobuyuki Taguchi, Kanagawa (JP); Hiromichi Ninomiya, Kanagawa (JP); Norio Kudo, Kanagawa (JP); Kenji Honjoh, Kanagawa (JP); Yuta Azeyanagi, Kanagawa (JP)

(72) Inventors: Akira Fujimori, Kanagawa (JP); Satoshi Hatori, Kanagawa (JP); Naohiro Kumagai, Kanagawa (JP); Kaoru Yoshino, Tokyo (JP); Hideyasu Seki, Chiba (JP); Ryohta Gotoh, Tokyo (JP); Takeshi Shintani, Kanagawa (JP); Nobuyuki Taguchi, Kanagawa (JP); Hiromichi Ninomiya, Kanagawa (JP); Norio Kudo, Kanagawa (JP); Kenji Honjoh, Kanagawa (JP); Yuta Azeyanagi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 11 days.

(21) Appl. No.: 13/827,444

(22) Filed: Mar. 14, 2013

(65) Prior Publication Data

US 2013/0251380 A1 Sep. 26, 2013

(30) Foreign Application Priority Data

Mar. 22, 2012 (JP) ..... 2012-065158
Oct. 1, 2012 (JP) ..... 2012-219632

(51) Int. Cl.
*G03G 15/00* (2006.01)
*G03G 21/00* (2006.01)

(52) U.S. Cl.
CPC ..... *G03G 15/553* (2013.01); *G03G 21/0094* (2013.01)

(58) Field of Classification Search
CPC ..... G03G 15/55
USPC ..... 399/88, 24
See application file for complete search history.

(56) References Cited

U.S. PATENT DOCUMENTS

2007/0059067 A1 3/2007 Tanaka et al.
2007/0172273 A1 7/2007 Harada et al.
2007/0258743 A1 11/2007 Shakuto et al.
2008/0089726 A1 * 4/2008 Hatakeyama et al. ..... 399/346

(Continued)

FOREIGN PATENT DOCUMENTS

CN 102221806 A 10/2011
CN 102236316 A 11/2011

(Continued)

OTHER PUBLICATIONS

Machine translation of Kosuge JP 2010-271665 A, publication date: Dec. 2, 2010.*

(Continued)

*Primary Examiner* — Walter L Lindsay, Jr.
*Assistant Examiner* — Frederick Wenderoth
(74) *Attorney, Agent, or Firm* — Oblon, McClelland, Maier & Neustadt, L.L.P.

(57) ABSTRACT

In an embodiment, provided is a lubricant supplying device that includes: a solid lubricant; a supplying member that supplies lubricant of the solid lubricant to a lubricant supplying target; and a remaining amount detecting unit that detects an amount of the solid lubricant being at a given amount or less. The remaining amount detecting unit is provided on a downstream side in a rubbing direction of the supplying member with respect to the solid lubricant.

20 Claims, 13 Drawing Sheets

(56) References Cited

U.S. PATENT DOCUMENTS

| | | | | |
|---|---|---|---|---|
| 2008/0181689 | A1 | 7/2008 | Fujimori | |
| 2009/0060600 | A1 | 3/2009 | Ninomiya et al. | |
| 2009/0103944 | A1 | 4/2009 | Shintani | |
| 2010/0183349 | A1 | 7/2010 | Shintani et al. | |
| 2011/0076075 | A1 | 3/2011 | Arai et al. | |
| 2011/0123239 | A1 | 5/2011 | Azeyanagi et al. | |
| 2011/0170908 | A1 | 7/2011 | Saitoh et al. | |
| 2011/0217101 | A1 | 9/2011 | Okamoto et al. | |
| 2011/0229232 | A1 | 9/2011 | Kojima et al. | |
| 2013/0251382 | A1* | 9/2013 | Honjoh et al. | 399/25 |

FOREIGN PATENT DOCUMENTS

| | | |
|---|---|---|
| JP | 08-314346 | 11/1996 |
| JP | 2008-20783 | 1/2008 |
| JP | 2010-271665 | 12/2010 |
| JP | 2011-107591 | 6/2011 |
| JP | 2011-107592 | 6/2011 |
| JP | 2011-197126 | 10/2011 |
| NO | 2007-225847 | 9/2007 |

OTHER PUBLICATIONS

Machine translation of Sawada JP 2007-225847 A, publication date: Sep. 6, 2007.*

U.S. Appl. No. 13/790,017, filed Mar. 8, 2013, Hatori, et al.

U.S. Appl. No. 13/848,307, filed Mar. 21, 2013, Seki, et al.

U.S. Appl. No. 13/847,556, filed Mar. 20, 2013, Gotoh, et al.

Office Action issued Jan. 30, 2015 in Chinese Patent Application No. 201310089634.4 (with English translation).

* cited by examiner (a)

(b)

LUBRICANT SUPPLYING DEVICE, IMAGE FORMING APPARATUS, AND PROCESS CARTRIDGE

CROSS-REFERENCE TO RELATED APPLICATIONS

The present application claims priority to and incorporates by reference the entire contents of Japanese Patent Application No. 2012-065158 filed in Japan on Mar. 22, 2012 and Japanese Patent Application No. 2012-219632 filed in Japan on Oct. 1, 2012.

BACKGROUND OF THE INVENTION

1. Field of the Invention

The present invention relates to a lubricant supplying device, an image forming apparatus, and a process cartridge.

2. Description of the Related Art

In image forming apparatuses such as printers, facsimiles, and copying machines, it is known that, for the protection of and lowering the friction of an image carrier such as a photosensitive element and an intermediate transfer belt, some apparatuses are provided with a lubricant supplying device that supplies lubricant to the surface of the image carrier.

In image forming apparatuses such as printers, facsimiles, and copying machines, it is known that, to protect and to lower the friction of an image carrier such as a photosensitive element and an intermediate transfer belt as a lubricant supplying target, some apparatuses are provided with a lubricant supplying device that supplies lubricant to the surface of the image carrier.

A lubricant supplying device includes a supplying member that abuts a bar-shaped solid lubricant to rub off lubricant and supplies the lubricant in fine powder to an image carrier. The lubricant supplying device further includes a lubricant retaining member that retains the solid lubricant at the portion on the side opposite to the side that abuts the supplying member. The lubricant retaining member is housed in a case of the lubricant supplying device to be movable in a contacting and separating direction of the solid lubricant with respect to the supplying member. Furthermore, in a space on the side opposite to the side of the lubricant retaining member that retains the solid lubricant inside the case, a pressing mechanism that presses the lubricant retaining member on the side opposite to the side that retains the solid lubricant towards the supplying member.

When the supplying member rotates, the solid lubricant abutting thereon is rubbed, and the lubricant rubbed off and adhered onto the supplying member is applied to the surface of the image carrier. The solid lubricant is gradually scraped off by rubbing of the supplying member, and the lubricant retaining member moves towards the supplying member. The solid lubricant abuts the supplying member from the beginning to the end of use; and thus, the solid lubricant can be scraped off favorably by the supplying member.

When image forming operation is performed while the lubricant is exhausted, as the protective action of the lubricant is not exercised, the image carrier is worn and is deteriorated. In Japanese Patent Application Laid-open No. 2011-197126, disclosed is a lubricant supplying device including a remaining amount detecting unit that detects the length of the solid lubricant in a moving direction thereof (hereinafter, referred to as a height of the solid lubricant) to be at a given value or less while being scraped off by the supplying member so as to detect that the remaining amount of lubricant is so small.

The lubricant supplying device disclosed in Japanese Patent Application Laid-open No. 2011-197126 is provided with an electrode member in a lateral direction of the solid lubricant (a moving direction of the surface of the supplying member at an abutting portion between the solid lubricant and the supplying member) as a remaining amount detecting unit, and when the remaining amount of lubricant becomes so small, the electrode member and the conductive lubricant retaining member abut each other and become a conductive state from a non-conductive state. Accordingly, becoming a conductive state from a non-conductive state detects the remaining amount of lubricant being so small.

In the lubricant supplying device disclosed in Japanese Patent Application Laid-open No. 2011-197126, however, it is found that the electrode member and the lubricant retaining member sometimes do not make contact with each other, even when the remaining amount of lubricant of the solid lubricant becomes so small, causing an erroneous detection.

In view of the above-described situation, there is a need to provide a lubricant supplying device, an image forming apparatus, and a process cartridge that can prevent an erroneous detection of the remaining amount detecting unit.

The applicants have identified the following as a result of their devoted studies on the root cause of the electrode member and the lubricant retaining member not making contact with each other causing an erroneous detection even when the remaining amount of lubricant of the solid lubricant becomes so small. More specifically, it is found that, when the electrode member as the remaining amount detecting unit is arranged on the upstream side in a rubbing direction of the supplying member with respect to the solid lubricant, the electrode member and the lubricant retaining member do not make contact with each other causing an erroneous detection. The solid lubricant receives force towards the downstream side in the rubbing direction of the supplying member at the portion abutting the supplying member. When the solid lubricant receives force towards the downstream side in the rubbing direction by rubbing of the supplying member, the lubricant retaining member moves towards the downstream side in the rubbing direction of the supplying member with respect to the solid lubricant. As a result, when the electrode member as the remaining amount detecting unit is provided on the upstream side in the rubbing direction of the supplying member with respect to the solid lubricant, the electrode member and the lubricant retaining member do not make contact with each other even when the remaining amount of lubricant of the solid lubricant becomes so small, thereby causing an erroneous detection.

While a failure caused by using the remaining amount detecting unit that detects electrical conduction between the electrode member and the lubricant retaining member being provided on the upstream side in the rubbing direction of the supplying member with respect to the solid lubricant is explained in the foregoing, it is not limited to this. For example, even with a lubricant supplying device that includes a remaining amount detecting unit that detects the remaining amount by a detected portion pressing a push switch when the remaining amount of lubricant comes to a near end, when the push switch as a remaining amount detecting unit is arranged on the upstream side in the rubbing direction of the supplying member with respect to the solid lubricant, the detected portion does not make contact with the push switch causing the same failure as that in the foregoing. Furthermore, even with a lubricant supplying device that includes a remaining amount detecting unit that detects the remaining amount by a detected portion that faces a photo interrupter when the remaining amount of lubricant comes to a near end, when the photo interrupter is arranged on the upstream side in the rubbing direction of the supplying member with respect to the solid lubricant, the detected portion does not face the photo interrupter causing the same failure as that in the foregoing.

SUMMARY OF THE INVENTION

It is an object of the present invention to at least partially solve the problems in the conventional technology.

In an embodiment, provided is a lubricant supplying device that includes: a solid lubricant; a supplying member that supplies lubricant of the solid lubricant to a lubricant supplying target; and a remaining amount detecting unit that detects an amount of the solid lubricant being at a given amount or less. The remaining amount detecting unit is provided on a downstream side in a rubbing direction of the supplying member with respect to the solid lubricant.

In another embodiment, provided is an image forming apparatus that includes: an image carrier; and a lubricant supplying unit that supplies lubricant to a surface of the image carrier. The image forming apparatus transfers an image on the image carrier onto a recording material to form an image on the recording material, and the lubricant supplying unit is the lubricant supplying device described above.

In still another embodiment, provided is a process cartridge that includes: an image carrier; and a lubricant supplying unit that supplies lubricant to a surface of the image carrier. The process cartridge is configured to be detachably attached to a body of an image forming apparatus, and the lubricant supplying unit is the lubricant supplying device described above.

Therefore, the above-described remaining amount detecting unit is arranged on the downstream side in the rubbing direction of the supplying member with respect to the solid lubricant. Consequently, the detected portion such as a lubricant retaining member that is detected by the remaining amount detecting unit can be detected more reliably by the remaining amount detecting unit, whereby an erroneous detection can be prevented.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An exemplary embodiment of a printer that is an image forming apparatus in electrophotography will be described hereinafter.

Figure 1:
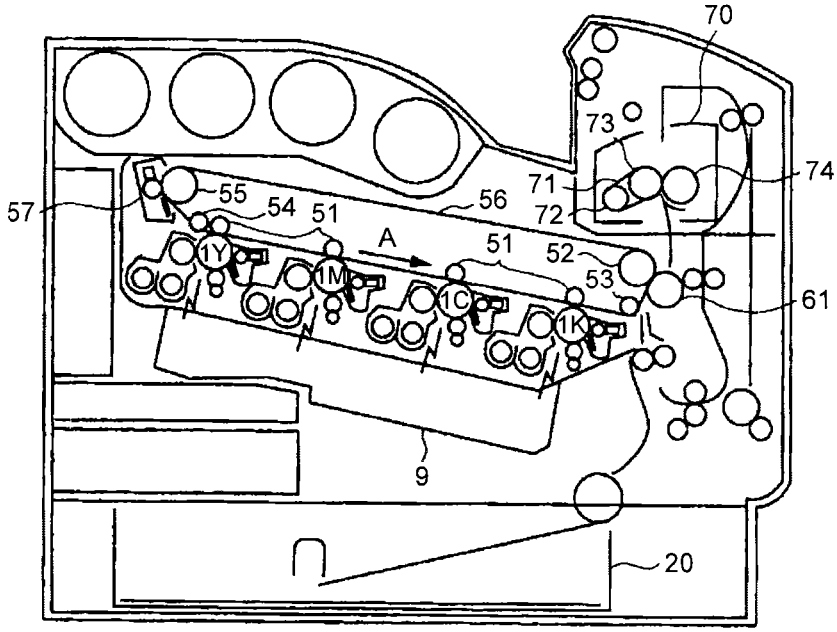
FIG. 1 is a schematic diagram illustrating a configuration of a printer according to a first embodiment.

FIG. 1 is a schematic diagram illustrating a configuration of the printer according to a first embodiment.

The printer includes in the middle of the printer an intermediate transfer belt 56 as an intermediate transfer body that is an image carrier. The intermediate transfer belt 56 is made of heat resistant material such as polyimide and polyamide, and is an endless belt composed of a base substrate adjusted to a moderate resistance. The intermediate transfer belt 56 is stretched and supported by four rollers 52, 53, 54, and 55, and is driven to rotate in a direction of an arrow A in FIG. 1. Below the intermediate transfer belt 56, four units of image forming units corresponding to respective colors of yellow (Y), magenta (M), cyan (C), and black (K) are lined along the belt surface of the intermediate transfer belt 56.

Figure 2:
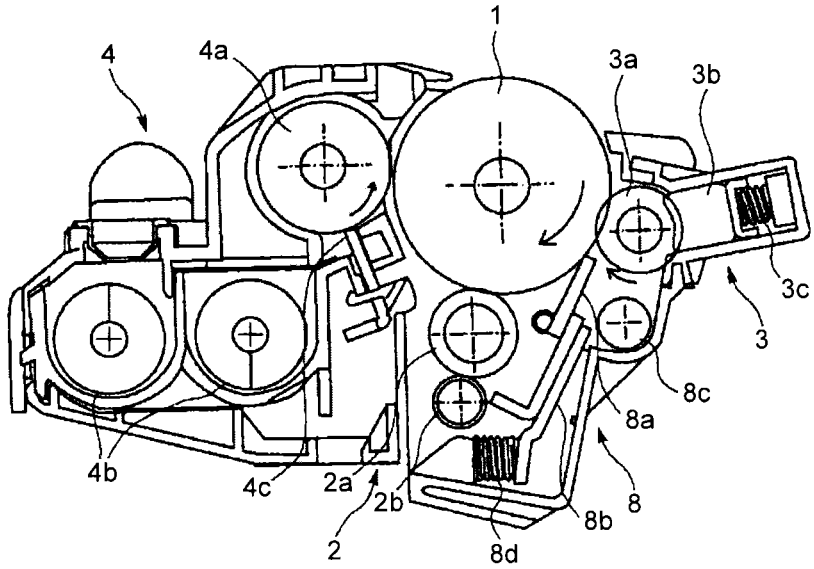
FIG. 2 is an enlarged view illustrating one of four image forming units.

FIG. 2 is an enlarged view illustrating one of the four image forming units.

Because all the image forming units have the same configuration, the suffixes of Y, M, C, and K indicating difference in color are omitted here. Each of the image forming units has a photosensitive element 1 as an image carrier, and around each photosensitive element 1, arranged are a charging device 2 as a charging unit that uniformly charges the surface of the photosensitive element to be at a desired potential (in negative polarity), a developing device 4 as a developing unit that develops a latent image formed on the surface of the photosensitive element as a toner image with toner of the respective colors charged in the negative polarity, a lubricant applying device 3 that is a lubricant supplying device that supplies lubricant by applying it on the surface of the photosensitive element, and a cleaning device 8 that performs cleaning of the surface of the photosensitive element after the toner image is transferred.

The image forming unit is configured as a process cartridge detachable from the image forming apparatus, and is configured such that the photosensitive element 1, the charging device 2, the developing device 4, the cleaning device 8, and the lubricant applying device 3 are replaced collectively at one time.

Referring to FIG. 1, below the four image forming units, provided is an exposing device 9 as an electrostatic latent image forming unit that exposes the charged surface of each of the photosensitive elements to light based on image data of respective colors to lower the potential of an exposed area to write an electrostatic latent image. At the positions facing the respective photosensitive elements 1 across the intermediate transfer belt 56, arranged are primary transfer rollers 51 as a transfer unit that performs primary transfer of the toner image formed on the photosensitive element 1 onto the intermediate transfer belt 56. The primary transfer rollers 51 are connected to a power supply not depicted and are applied with a given voltage.

On the outer side of the portion of the intermediate transfer belt 56 supported by the roller 52, a secondary transfer roller 61 as a secondary transfer unit is pressed into contact. The secondary transfer roller 61 is connected to a power supply not depicted and is applied with a given voltage. The contacting portion of the secondary transfer roller 61 and the intermediate transfer belt 56 is a secondary transfer portion, and the toner image on the intermediate transfer belt 56 is transferred onto a transfer sheet as a recording material. On the outer side of the portion of the intermediate transfer belt 56 supported by the roller 55, provided is an intermediate transfer belt cleaning device 57 that cleans the surface of the intermediate transfer belt 56 after the secondary transfer. Above the secondary transfer portion, provided is a fixing device 70 that fixes the toner image on the transfer sheet to the transfer sheet. The fixing device 70 is configured with an endless fixing belt 71 wound between a heating roller 72 having a halogen heater inside and a fixing roller 73, and a pressing roller 74 arranged to face and to press the fixing roller 73 via the fixing belt 71. At the bottom portion of the printer, provided is a feeding device 20 on which transfer sheets are placed and from which the transfer sheets are sent out towards the secondary transfer portion.

The photosensitive element 1 is an organic photosensitive element, and a surface protecting layer made of polycarbonate-based resin is formed. The charging device 2 includes a charging roller 2*a* as a charging member composed of a conductive core metal with an elastic layer of a moderate resistance covering the outer side thereof. The charging roller 2*a* is connected to a power supply not depicted and is applied with a given voltage. The charging roller 2*a* is arranged to have a minute gap with respect to the photosensitive element 1. The minute gap can be set, for example, by winding spacers having a constant thickness around non-image forming areas on both end portions of the charging roller 2*a* and making the surfaces of the spacers abut the surface of the photosensitive element 1. On the charging roller 2*a*, a charge cleaning member 2*b* that contacts and cleans the surface of the charging roller 2*a* is further provided.

In the developing device 4, arranged at the position facing the photosensitive element 1 is a developing sleeve 4*a* as a developer carrier that includes inside a magnetic field generator. Below the developing sleeve 4*a*, provided are two screws 4*b* that mix toner fed from a toner bottle not depicted with developer and scoop up the mixture to the developing sleeve 4*a* while agitating. The developer composed of the toner and magnetic carriers scooped up by the developing sleeve 4*a* is regulated by a doctor blade 4*c* to a developer layer of a given thickness and is carried on the developing sleeve 4*a*. The developing sleeve 4*a* carries and conveys the developer while moving in the same direction as that of the photosensitive element 1 at the position facing the photosensitive element 1, and supplies the toner to the latent image portion on the photosensitive element 1. In FIG. 1, the configuration of the developing device 4 of a two-component developer type is exemplified. However, it is not restricted to this, and it is applicable to a developing device of a single-component developer type.

The lubricant applying device 3 includes a solid lubricant 3*b* housed in a secured case, and an applying roller 3*a* as a supplying member constituting an applicator that applies lubricant in a powder form scraped off from the solid lubricant 3*b* to the surface of the photosensitive element 1. For the applying roller 3*a*, a brush roller and a urethane foam roller can be used. When a brush roller is used as the applying roller 3*a*, preferable is a brush roller formed of a material of resin such as nylon and acrylic resin in which a resistance control material such as carbon black is added to adjust its volume resistivity in a range from $1\times10^3$ Ω/cm or more to $1\times10^8$ Ωcm or less. The rotational direction of the applying roller 3*a* is a counter direction with respect to the photosensitive element 1. More specifically, at the abutting portion between the photosensitive element 1 and the applying roller 3*a*, the moving direction of the surface of the applying roller 3*a* is in a direction opposite to the moving direction of the surface of the photosensitive element 1. Furthermore, the rotational direction of the applying roller 3*a* may be set in a direction to follow the rotation of the photosensitive element 1.

The solid lubricant 3*b* is formed in a rectangular parallelepiped shape, and is pressed towards the applying roller 3*a* side by a later described pressing mechanism 3*c*. As for the lubricant of the solid lubricant 3*b*, the lubricant that contains at least a fatty acid metal salt is used. As for the fatty acid metal salt, for example, a substance of a fatty acid metal salt having a lamellar crystal structure such as fluorine-based resin, zinc stearate, calcium stearate, barium stearate, aluminum stearate, and magnesium stearate, or a substance such as lauroyl lysine, mono-cetyl phosphate ester sodium zinc salt, and lauroyl taurine calcium can be used. Out of these fatty acid metal salts, it is particularly preferable to use zinc stearate. This is because that zinc stearate has excellent extensibility on the surface of the photosensitive element 1 and low moisture absorbency, and further has characteristics of lubricity being hard to be impaired even when humidity is changed. Accordingly, formed can be a protective layer of lubricant in a film form that is not sensitive to environmental changes and has high ability of protecting the surface of the photosensitive element, whereby the surface of the photosensitive element can be protected favorably. Having the lubricity that is hard to be impaired allows achieving an effect of favorably reducing poor cleaning. Besides the fatty acid metal salts in the foregoing, material of silicone oil, fluorine-based oil, natural wax, and such in a form of liquid or in a form of gas can be added as an external addition method.

Furthermore, it is preferable that the lubricant of the solid lubricant 3*b* contain boron nitride that is inorganic lubricant. The crystal structure of boron nitride includes low-pressure phase hexagonal boron nitride (h-BN) and high-pressure phase cubic boron nitride (c-BN). Out of the boron nitride of these structures, a crystal of low-pressure phase hexagonal boron nitride has a layered structure and is a substance of easy cleavage, and thus, the friction coefficient thereof can be maintained at about 0.2 or less at a temperature of close to 400 degrees Celsius. The characteristics thereof are hard to be changed by discharge, and even when the discharge is received, the lubricity is not lost compared to other kinds of lubricant. Adding such boron nitride makes the lubricant supplied to the surface of the photosensitive element 1 and formed in a thin film deteriorate not in an early stage by the discharge that occurs when the charging device 2 and the primary transfer rollers 51 operate. The characteristics of boron nitride are hard to be changed by the discharge, and even when the discharge is received, the lubricity is not lost compared to the other kinds of lubricant. In addition, the photosensitive layer of the photosensitive element 1 can be prevented from being oxidized and evaporated by discharge. Furthermore, because the boron nitride can exercise its lubricity even with only a small fraction of additive amount, it is effective for failures caused by the adherence of lubricant to the charging roller 2*a* and such and for blade squeaking of a cleaning blade 8*a*.

In the solid lubricant 3*b* in the first embodiment, a compression-molded lubricant material containing zinc stearate and boron nitride is used. The molding method of the solid lubricant 3*b* is not restricted to this, and other molding methods such as a melt process may be adopted. Consequently, the effects of the above-described zinc stearate and the effects of the above-described boron nitride can be obtained.

The solid lubricant 3*b* is scraped off by the applying roller 3*a* and consumed, and the thickness thereof is reduced with time. However, because the solid lubricant 3*b* is pressed by the pressing mechanism 3*c*, the solid lubricant 3*b* is abutted on the applying roller 3*a* at all times. The applying roller 3*a* applies the lubricant scraped off to the surface of the photosensitive element as the applying roller 3*a* rotates. Thereafter, by the contact of the surface of the photosensitive element 1 and the cleaning blade 8*a*, the applied lubricant is spread out to be in a thin-film form. This makes the friction coefficient of the surface of the photosensitive element 1 lower. Because the film of lubricant adhered on the surface of the photosensitive element 1 is extremely thin, it does not interfere the charging by the charging roller 2*a*.

The cleaning device 8 includes the cleaning blade 8*a* as a cleaning member, a supporting member 8*b*, a toner collection coil 8*c*, and a blade pressing spring 8*d*. The cleaning blade 8*a* is made by forming urethane rubber, silicone rubber, and such into a plate shape, and is provided such that the edge thereof abuts the surface of the photosensitive element 1 to remove residual toner on the photosensitive element 1 after transfer. The cleaning blade 8*a* is stuck to and supported by the supporting member 8*b* made of metal, plastic, ceramic, and such, and is arranged at a given angle with respect to the surface of the photosensitive element 1. By the blade pressing spring 8*d*, the cleaning blade 8*a* abuts the surface of the photosensitive element 1 with a given abutting pressure and a given entry amount. As for the cleaning member, besides the cleaning blade, a known member such as a cleaning brush can be extensively used.

In the first embodiment, the lubricant applying device 3 is arranged on the downstream side in the moving direction of the surface of the photosensitive element than the position at which the photosensitive element 1 faces the primary transfer roller 51 (primary transfer portion) and on the upstream side than the cleaning device 8. Accordingly, the lubricant applied to the surface of the photosensitive element by the lubricant applying device 3 is subsequently stretched by the cleaning blade 8*a* rubbing the surface of the photosensitive element, whereby uneven application of the lubricant applied on the surface of the photosensitive element can be roughly smoothed out. The lubricant applying device 3 may be arranged on the downstream side in the moving direction of the surface of the photosensitive element than the position at which the photosensitive element 1 faces the cleaning device 8 (cleaning position) and on the upstream side than the position at which the photosensitive element 1 faces the charging device 2 (charging position). In that case, when a neutralization unit that neutralizes the surface of the photosensitive element before the charging process is performed at the charging device 2 is provided, the lubricant applying device 3 is arranged on the upstream side than the position at which the photosensitive element 1 faces the neutralization unit (neutralizing position).

Furthermore, in the first embodiment, the lubricant applying device 3 is provided inside the cleaning device 8. Accordingly, when the photosensitive element 1 is rubbed, the toner adhered onto the applying roller 3*a* can be shaken off by the solid lubricant 3*b* or a flicker not depicted and be easily collected by the toner collection coil 8*c* together with the toner collected by the cleaning blade 8*a*.

The lubricant applying device 3 will be described in more detail.

Figure 3:
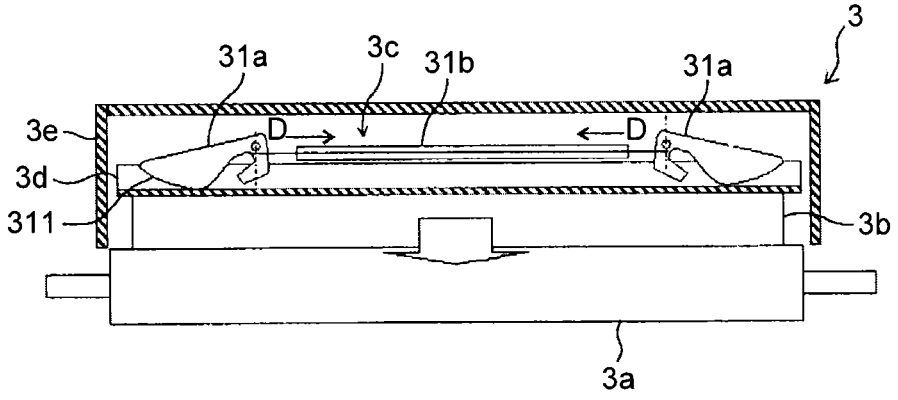
FIG. 3 is a schematic diagram illustrating a configuration of a lubricant applying device.

FIG. 3 is a schematic diagram illustrating the configuration of the lubricant applying device 3.

As illustrated in FIG. 3, provided is a lubricant retaining member 3*d* that retains the solid lubricant 3*b* at a portion on the side opposite to the surface of the solid lubricant 3*b* abutting the applying roller 3*a* (the surface on the lower side in FIG. 3) extending in the longitudinal direction thereof. The lubricant retaining member 3*d* is provided in a housing case 3*e* to contact and separate with respect to the applying roller 3*a*. Furthermore, in a space of the housing case 3*e* above the lubricant retaining member 3*d* in FIG. 3, provided is the pressing mechanism 3*c* that presses the lubricant retaining member 3*d* towards the supplying member.

The pressing mechanism 3*c* includes swinging members 31*a* provided near the both end portions of the lubricant retaining member 3*d* in the longitudinal direction and attached to the housing case 3*e* to swing freely, and a spring 31*b* that is a biasing unit. Each end portion of the spring 31*b* is attached to each of the swinging members 31*a*. Each of the swinging members 31*a* gains a biasing force from the spring 31*b* in a direction towards the center of the lubricant retaining member in the longitudinal direction indicated by respective arrows D in FIG. 3. By the biasing force, the swinging member on the right side in FIG. 3 is biased to swing in the clockwise direction, and the swinging member on the left side in FIG. 3 is biased to swing in the counter-clockwise direction. Accordingly, an arc-shaped abutting portion 311 of each of the swinging members 31*a* that abuts the lubricant retaining member 3*d* is biased towards the lubricant retaining member 3*d* as illustrated in FIG. 3.

At the beginning of use, a swinging end portion of each of the swinging members 31*a* is in a state of being swung in a direction to be close to an inner periphery surface 32 at the upper portion of the housing case 3*e* resisting the biasing force of the spring 31*b*. By such a configuration, two of the swinging members 31*a* receive the biasing force of the spring 31*b*, and by an equal force to each other, press the lubricant retaining member 3*d* to press the solid lubricant 3*b* retained by the lubricant retaining member 3*d* towards the applying roller 3*a*. Therefore, the solid lubricant 3*b* is pressed to the applying roller 3*a* evenly in the longitudinal direction. As a result, the amount of lubricant scraped off by rubbing by the rotation of the applying roller 3*a* becomes uniform in the longitudinal direction, whereby the lubricant can be applied evenly to the surface of the photosensitive element 1.

Figure 4:
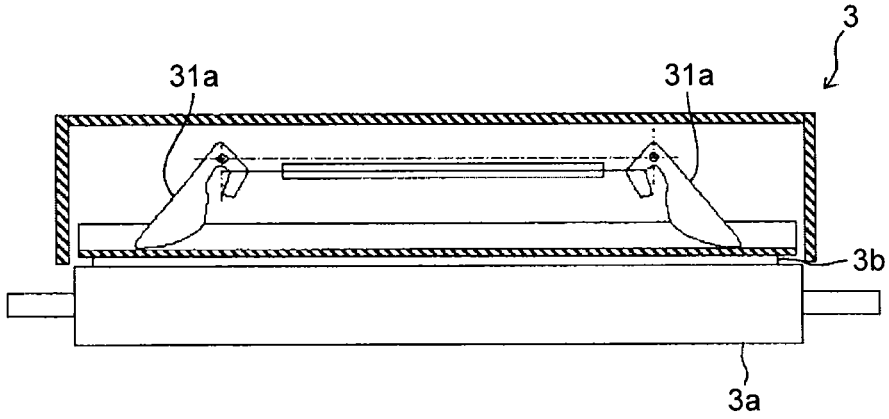
FIG. 4 is a schematic diagram illustrating the configuration of the lubricant applying device at the end of use.

FIG. 4 is a schematic diagram illustrating the configuration of the lubricant applying device 3 at the end of use (when the remaining amount of the solid lubricant is so small).

When the solid lubricant 3*b* is scraped off gradually by rubbing of the applying roller 3*a*, the swinging members 31*a* swing and the lubricant retaining member 3*d* moves towards the applying roller. When the amount of the solid lubricant becomes so small eventually, as illustrated in FIG. 4, the swinging end portions of the swinging members 31*a* abut the lubricant retaining member 3*d*.

In the pressing mechanism 3*c* in the first embodiment, even when the height of the solid lubricant 3*b* is reduced by the use over time, the reduction in the pressing force for the solid lubricant 3*b* can be suppressed. Accordingly, the variations in the amount of powdered lubricant supplied to the surface of the photosensitive element 1 can be suppressed to be small from the beginning over the course of use.

The reasons for achieving such results are as follows.

Generally, for the amount of change in elongation of a spring that changes from the beginning until the solid lubricant 3*b* is consumed, the longer the length of the whole spring, the smaller the variation of change in biasing force for the amount of change in the elongation of the spring. In a conventional pressing mechanism, a spring is arranged in a shrunk state, and the direction of the biasing force (extrusion force) and the pressing direction of the solid lubricant 3*b* with respect to the applying roller 3*a* are made to agree with each other. In this configuration, when the length of the whole spring is made longer, it becomes more difficult to make the direction of the biasing force of the spring and the pressing direction of the solid lubricant 3*b* with respect to the applying roller 3*a* agree, whereby lengthening the length of the whole spring has limitations. In addition, in the conventional pressing mechanism, a placement space for the length of the spring in the radial direction of the applying roller 3*a* needs to be secured, thereby making the device larger in size. Due to the reasons in the foregoing, in the conventional pressing mechanism, a relatively short spring is forced to be used, and thus the variation in biasing force of the spring over time becomes large.

In contrast, in the pressing mechanism 3*c* in the first embodiment, as illustrated in FIG. 3, the spring 31*b* is arranged in an elongated state, and the solid lubricant 3*b* can be pressed to the applying roller 3*a* by the biasing force thereof (tensile force). Therefore, even when the length of the whole spring is lengthened, the issues as described with the conventional pressing mechanism do not arise. Moreover, in the pressing mechanism 3*c* in the first embodiment, the spring 31*b* is arranged such that the length direction of the spring 31*b* agrees with the longitudinal direction of the solid lubricant 3*b*, i.e., the axis direction of the applying roller 3*a*. Accordingly, even when the length of the spring 31*b* is lengthened, the placement space does not expand in the radial direction of the applying roller 3*a*, and thus, the device is not necessary to be made larger in size. Therefore, the pressing mechanism 3*c* in the first embodiment can adopt the spring 31*b* the length of which is way longer than that of the spring used in the conventional pressing mechanism. As a consequence, the variation in the biasing force of the spring over time can be suppressed to be small.

Figure 5:
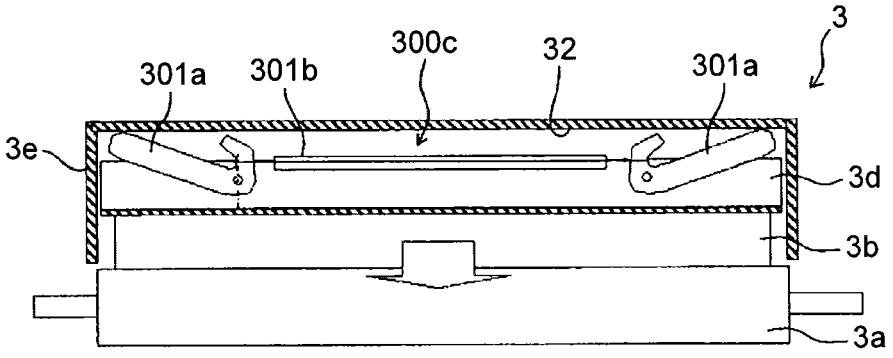
FIG. 5 is a schematic diagram illustrating a configuration of a lubricant applying device including a pressing mechanism in modification.

FIG. 5 is a schematic diagram illustrating the configuration of a lubricant applying device provided with a pressing mechanism according to modification.

A pressing mechanism 300*c* in the modification includes the lubricant retaining member 3*d* that is attached with respective swinging members 301*a* to swing freely. As a result, each of the swinging members 301*a* is configured such that a swinging end portion of each of the swinging members 301*a* is biased in a direction to separate from the lubricant retaining member 3*d* by the biasing force of a spring 301*b* towards the center in the longitudinal direction of the lubricant retaining member 3*d*, and the swinging end portion of each of the swinging members 301*a* abuts the inner periphery surface 32 at the upper portion of the housing case 3*e*.

As illustrated in FIG. 5, at the beginning of use, the swinging end portion of each of the swinging members 301*a* is arranged in a state of being swung in a direction to be close to the lubricant retaining member 3*d* resisting the biasing force of the spring 301*b*. In the modification, two of the swinging members 301*a* receive the biasing force of the spring 301*b*, and by an equal force to each other, press the inner periphery surface 32 at the upper portion of the case to press the solid lubricant 3*b* retained by the lubricant retaining member 3*d* towards the applying roller 3*a*. In the modification, when the solid lubricant 3*b* is scraped off gradually by rubbing of the applying roller 3*a*, the swinging members 301*a* swing and the lubricant retaining member 3*d* moves towards the applying roller. When the amount of the solid lubricant becomes so small eventually, each of the swinging members 301*a* swings to a state illustrated in FIG. 6.

Next, a remaining amount detecting mechanism (detector) 40 as a remaining amount detecting unit that detects a near end of the solid lubricant, which is one of the features of the first embodiment, will be described.

Figure 7:
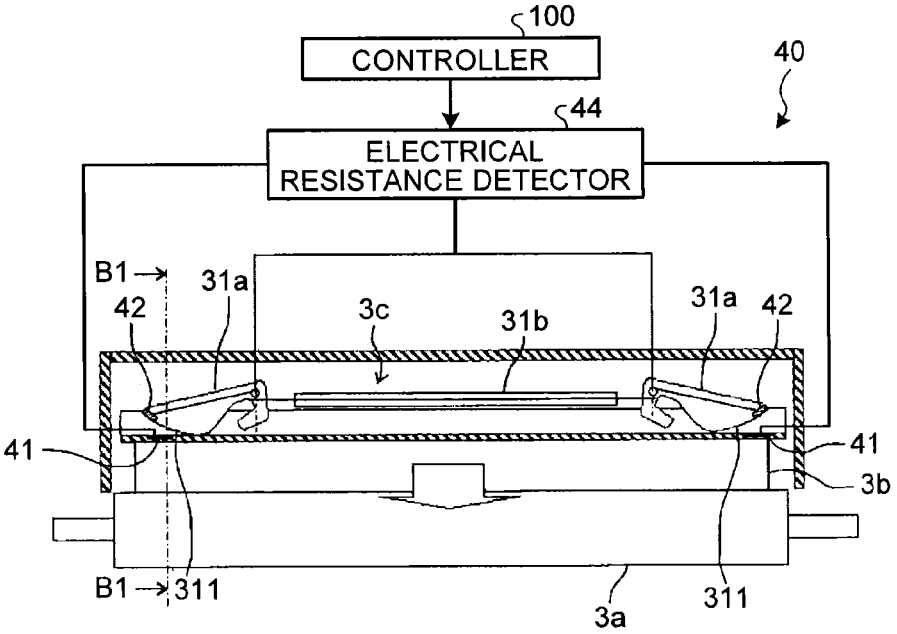
FIG. 7 is a schematic diagram illustrating a configuration of a lubricant applying device including a remaining amount detecting mechanism.
Figure 8:
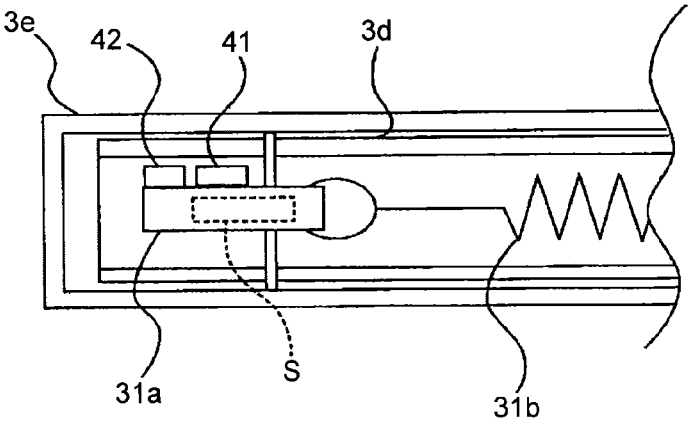
FIG. 8 is a plan view of a periphery of a swinging member on one side of the lubricant applying device in FIG. 7.
Figure 9:
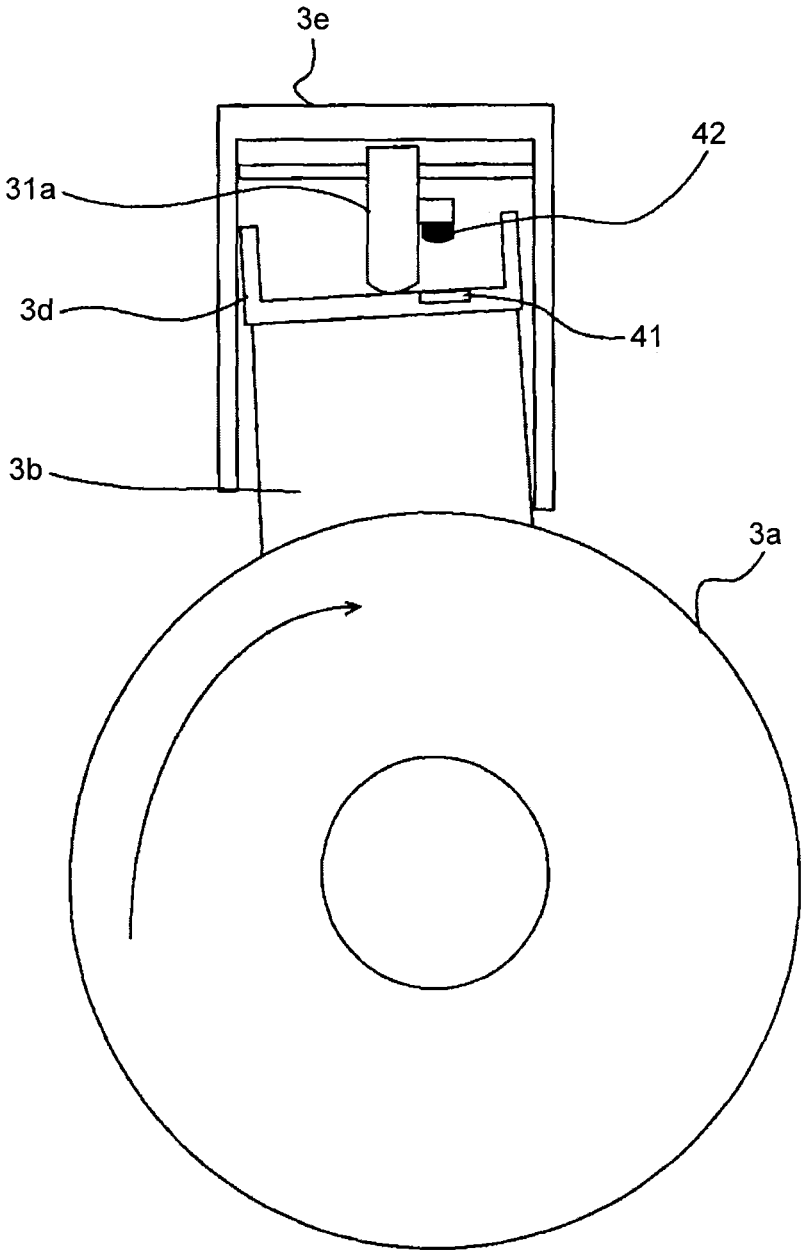
FIG. 9 is a cross-sectional view taken along the line B1-B1 in FIG. 7.

FIG. 7 is a schematic diagram illustrating the configuration of the lubricant applying device 3 including the pressing mechanism 3*c* exemplified in FIGS. 3 and 4 provided with the remaining amount detecting mechanism 40 in the first embodiment. FIG. 8 is a plan view of a periphery of the swinging member 31*a* on one side of the lubricant applying device 3 in FIG. 7. FIG. 9 is a cross-sectional view taken along the line B1-B1 in FIG. 7.

As illustrated in FIG. 7, the remaining amount detecting mechanism 40 includes first electrode members 41 as a first detecting member, second electrode members 42 as a detected portion, and others. The first electrode members 41 are provided on the surface facing the swinging members 31*a* of the lubricant retaining member 3*d* at near the both end portions thereof in the longitudinal direction. Each of the first electrode members 41 is arranged, as illustrated in FIGS. 8 and 9, to be displaced on the downstream side in the rubbing direction of the applying roller 3*a* on the solid lubricant (moving direction of the surface of the applying roller) with respect to a sliding area S on which the swinging member 31*a* of the lubricant retaining member 3*d* slides. Furthermore, the first electrode members 41 have a given length in the longitudinal direction so that the first electrode members 41 and the second electrode members 42 reliably abut at the time of a near end of the solid lubricant even when the lubricant retaining member 3*d* is displaced in the longitudinal direction.

The second electrode members 42 are provided, as illustrated in FIGS. 8 and 9, on the side surface of each of the swinging members 31*a* on the downstream side in the rubbing direction of the applying roller 3*a* on the solid lubricant (moving direction of the surface of the applying roller). Furthermore, the second electrode members 42 are arranged, as illustrated in FIG. 7, near the end portions of the swinging members 31*a* on the swinging side.

On the first electrode members 41 and each of the second electrode members 42, an electrical resistance detector 44 as a voltage applying unit is connected. The electrical resistance detector 44 is connected to a controller 100 that controls the electrical resistance detector 44. The electrical resistance detector 44 applies a voltage between the first electrode members 41 and the second electrode members 42 to measure electrical resistance.

As illustrated in FIGS. 7 and 9, at the beginning of use, the second electrode members 42 attached to the respective swinging members 31*a* are separated from the first electrode members 41 provided to the lubricant retaining member 3*d*, and are in a non-conductive state. Therefore, in this case, even when a voltage is applied between the first electrode members 41 and the second electrode members 42 by the electrical resistance detector 44, no current flows between the first electrode members 41 and the second electrode members 42 being in a state in which the measurement of a value of electrical resistance is not possible.

Figure 10:
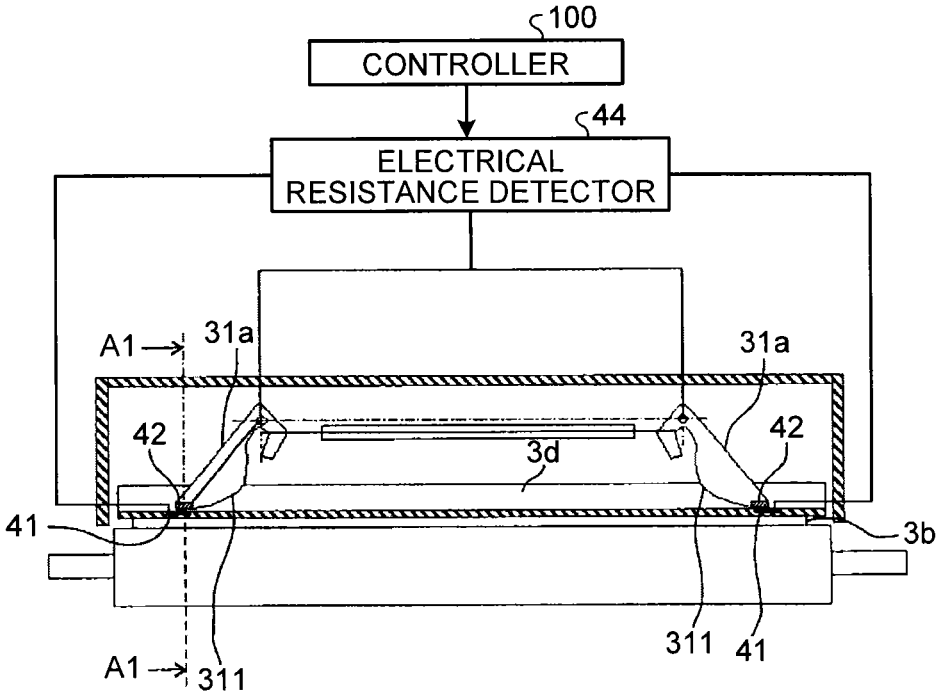
FIG. 10 is a diagram illustrating a solid lubricant in a near-end state.
Figure 11:
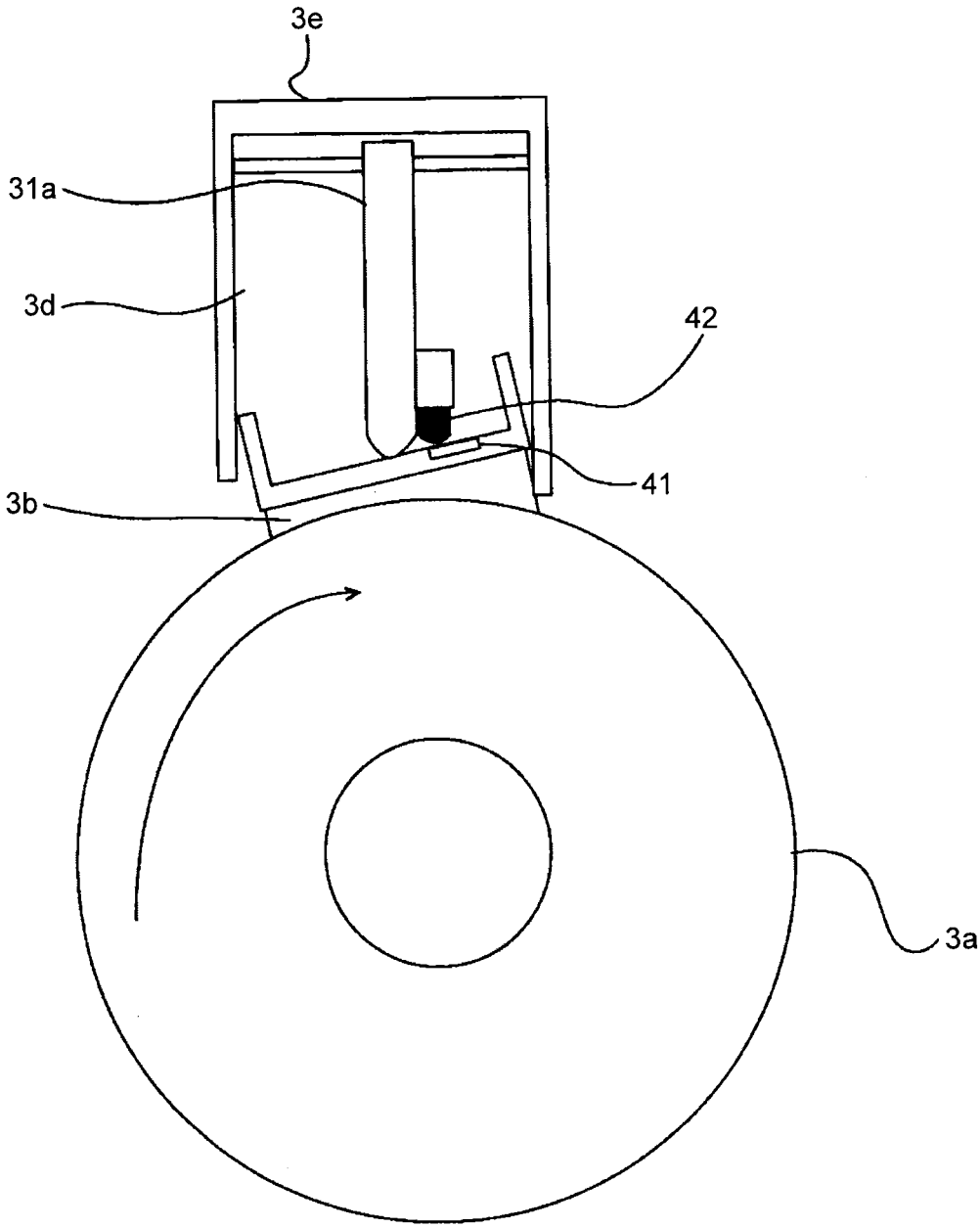
FIG. 11 is a cross-sectional view taken along the line A1-A1 in FIG. 10.

FIG. 10 is a diagram illustrating the solid lubricant 3*b* in a near-end state, and FIG. 11 is a cross-sectional view taken along the line A1-A1 in FIG. 10.

When the solid lubricant 3*b* is scraped off and the lubricant is consumed, the swinging members 31*a* swing sliding the surfaces of the lubricant retaining member 3*d*, and the second electrode members 42 gradually come closer to the first electrode members 41. As illustrated in FIGS. 10 and 11, when the remaining amount of the solid lubricant 3*b* becomes so small (near end), the second electrode members 42 abut the first electrode members 41. When the second electrode members 42 abut the first electrode members 41, the state of the first electrode members 41 and the second electrode members 42 switches from a non-conductive state to a conductive state. Accordingly, when the electrical resistance detector 44 applies a voltage between the first electrode members 41 and the second electrode members 42, a current flows between the first electrode members 41 and the second electrode members 42, whereby a value of electrical resistance is measured by the electrical resistance detector 44.

The controller 100 monitors the measuring result of the electrical resistance detector 44, and when the controller 100 detects that the value of electrical resistance detected by the electrical resistance detector 44 is a given value or less, the controller 100 determines a near end of lubricant. On an operation display unit not depicted, warned is that the remaining lubricant is low to prompt a user to replace the solid lubricant. Furthermore, using a communication unit not depicted, a service center may be notified that the replacement of lubricant is necessary.

The lubricant retaining member 3*d* is provided inside the housing case to be movable in the housing case in a direction to contact and separate with respect to the applying roller 3*a* (direction orthogonal to the plane of FIG. 8). Accordingly, the lubricant retaining member 3*d* is retained in the housing case 3*e* having some play in the longitudinal direction. The play (gap) of up to about one millimeter arises by fluctuations in the fixing precision of the lubricant retaining member 3*d* and the solid lubricant 3*b*, the component accuracy of the housing case 3*e*, and such. Therefore, the position of the lubricant retaining member 3*d* in use may be displaced in the longitudinal direction.

When it is configured that the first electrode member 41 is arranged at the left end of the sliding area S in FIG. 8 and the second electrode member 42 is arranged near the swinging end portion of the abutting portion of the swinging member 31*a* so that the first electrode member 41 and the second electrode member 42 abut each other at the time the solid lubricant comes to a near end, a portion other than the second electrode member 42 of the abutting portion of either one of the swinging members may abut the first electrode member 41 when the position of the lubricant retaining member 3*d* is displaced in the longitudinal direction. In this case, the material that the sliding member abuts changes along the way, and because of the difference in friction coefficient of the material, the sliding condition changes. Consequently, the sliding condition of the swinging member on the side in which the abutting portion abuts the first electrode member 41 differs from that of the swinging member on the side in which the abutting portion does not abut. As a consequence, the pressing force of the solid lubricant 3*b* to the applying roller 3*a* on one side in the longitudinal direction differs from that on the other side, and the amount of lubricant applied may differ in the axis direction of the photosensitive element.

In contrast, in the first embodiment, as illustrated in FIG. 8, the first electrode member 41 is arranged at a place different from the sliding area S on which the swinging member 31*a* of the lubricant retaining member 3*d* slides. Accordingly, even when the position of the lubricant retaining member 3*d* in use is displaced in the longitudinal direction, the abutting portion 311 of the swinging member never slides on the first electrode member 41. As a result, each of the swinging members swings in the same manner, and the pressing force of the solid lubricant 3*b* to the applying roller 3*a* can be made uniform in the longitudinal direction. Consequently, the amount of lubricant applied to the photosensitive element can be made uniform in the axis direction thereof.

The lubricant retaining member 3*d* and the housing case 3*e* further have some play in the lateral direction of the solid lubricant 3*b* (rubbing direction of the applying roller 3*a* on the solid lubricant). At the portion of the solid lubricant 3*b* abutting the applying roller 3*a*, by rubbing of the applying roller 3*a* on the solid lubricant 3*b*, the solid lubricant receives force towards the downstream side in the rubbing direction (on the downstream side in the moving direction of the surface of the applying roller 3*a*). Because there is a gap between the housing case 3*e* and the solid lubricant 3*b*, the abutting portion of the solid lubricant on the applying roller 3*a* moves towards the downstream side in the rubbing direction, and thus the integrated combination of the solid lubricant 3*b* and the lubricant retaining member 3*d* inclines in the housing case as illustrated in FIG. 9.

As the solid lubricant 3*b* is scraped off, the inclination of the integrated combination of the solid lubricant 3*b* and the lubricant retaining member 3*d* in the housing case gradually increases, and at a near end of the solid lubricant, as illustrated in FIG. 11, the integrated combination of the solid lubricant 3*b* and the lubricant retaining member 3*d* severely inclines. The reason for such severe inclination is that the height of the integrated combination from the abutting portion between the solid lubricant and the applying roller 3*a* becomes low, resulting in a severely inclined position.

When the first electrode member 41 and the second electrode member 42 are provided on the upstream side than the sliding area S in the moving direction of the surface of the applying roller, because the first electrode member 41 moves in a direction away from the second electrode member 42 by the inclination of the lubricant retaining member, the first electrode member 41 may not abut the second electrode member 42 at the time of a near end of the lubricant, whereby the near-end detection may not be made favorably. As a consequence, the solid lubricant may be exhausted and may no longer be able to protect the photosensitive element, whereby a failure such as wear of the photosensitive element may arise.

Furthermore, the lubricant retaining member 3*d* being inclined makes the sliding area S of the swinging member shift towards the upstream side in the rubbing direction compared to the beginning of use. For this reason, when the first electrode member 41 is arranged at the position shifted towards the upstream side in the rubbing direction with respect to the sliding area S, the abutting portion 311 of the swinging member 31*a* may slide on the first electrode member 41.

In contrast, in the first embodiment, as illustrated in FIGS. 9 and 11, because the first electrode member 41 is arranged at the position shifted towards the downstream side in the rubbing direction with respect to the sliding area S on which the swinging member 31*a* of the lubricant retaining member 3*d* slides, it is configured such that, when the lubricant retaining member 3*d* inclines, the first electrode member 41 comes closer towards the second electrode member 42 side. Accordingly, the first electrode member 41 can be made to abut the second electrode member 42 reliably, whereby the remaining amount of the solid lubricant can be detected. The second electrode member 42 is attached to the swinging member such that the second electrode member 42 abuts the first electrode member at the inclination of the lubricant retaining member corresponding to when the amount of lubricant of the solid lubricant 3*b* comes to a given amount or less.

Furthermore, that the first electrode member 41 being arranged at the position shifted on the downstream side in the rubbing direction with respect to the sliding area S on which the swinging member 31*a* of the lubricant retaining member 3*d* slides makes the abutting portion 311 of the swinging member never slide on the first electrode member 41. As a result, each of the swinging members swings in the same manner, and the pressing force of the solid lubricant 3*b* to the applying roller 3*a* can be made uniform in the longitudinal direction. Consequently, the amount of lubricant applied to the photosensitive element can be made uniform in the axis direction thereof.

In the first embodiment, when the amount of lubricant is before a near end, the first electrode member 41 and the second electrode member 42 are in a non-conductive state, and no current flows even when a voltage is applied between the electrode members. Accordingly, because the power is not consumed every time the near-end detection is performed, the reduction in power consumption can be achieved.

Furthermore, in the first embodiment, the conductive state of the first electrode member and the second electrode member is detected near the both end portions of the lubricant retaining member 3*d* in the longitudinal direction. Therefore, even when the consumed amount of lubricant of the solid lubricant 3*b* is different in the longitudinal direction, at the time the end portion on the side the amount of lubricant of which is consumed more comes to a near end, the second electrode member 42 of the end portion on the side the amount of lubricant of which is consumed more abuts the first electrode member 41 and becomes conductive. Accordingly, even when the consumed amount of lubricant of the solid lubricant 3*b* in the longitudinal direction is different, a near end of the lubricant can be detected accurately. As a consequence, prevented can be the occurrence of failure such as the surface of the photosensitive element being damaged because the lubricant is exhausted on the side the consumed amount of which is more and is no longer able to protect the surface of the photosensitive element.

Figure 6:
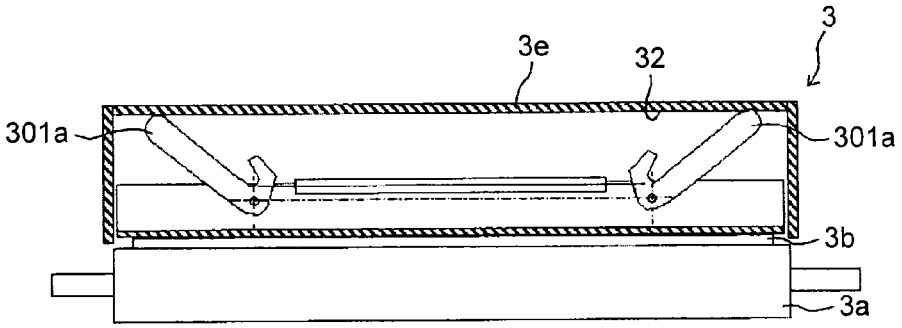
FIG. 6 is a schematic diagram illustrating the configuration of the lubricant applying device illustrated in FIG. 5 at the end of use.
Figure 12:
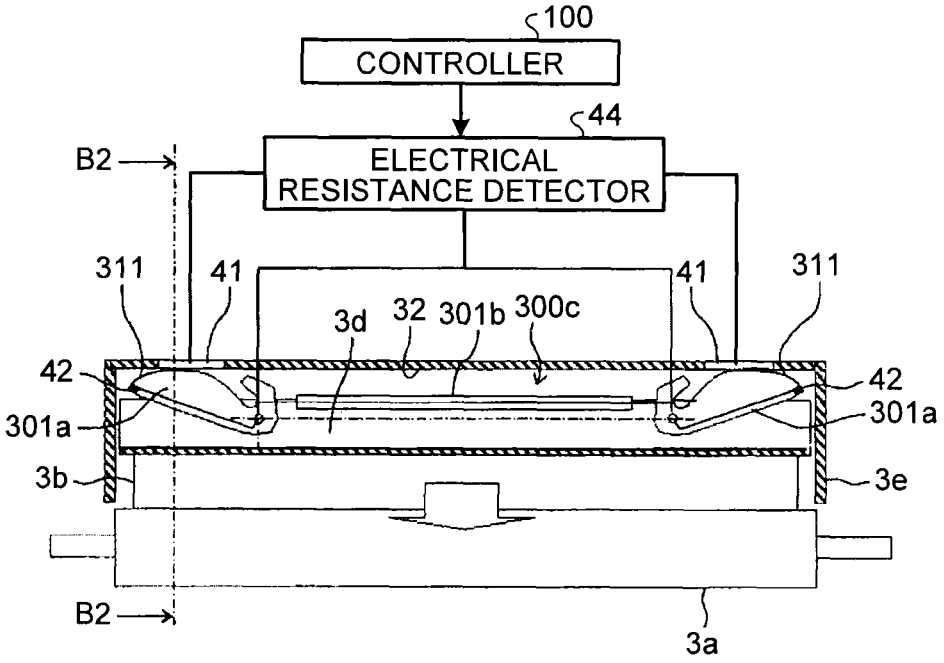
FIG. 12 is a diagram illustrating a configuration of the lubricant applying device including the pressing mechanism in the modification to which a remaining amount detecting mechanism is applied.
Figure 13:
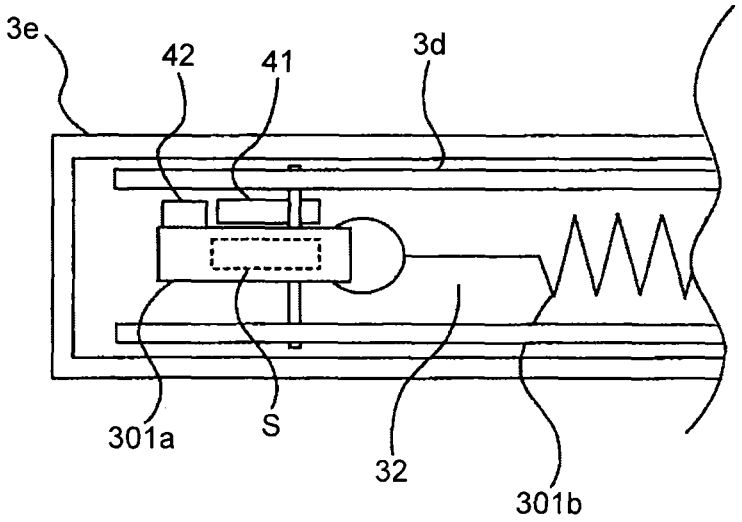
FIG. 13 is a bottom view of a periphery of a swinging member on one side of the lubricant applying device in FIG. 12.

FIG. 12 is a schematic diagram illustrating the configuration of the lubricant applying device 3 that includes the pressing mechanism 300*c* exemplified in FIGS. 5 and 6 being provided with the remaining amount detecting mechanism 40 in the first embodiment. FIG. 13 is a bottom view of a periphery of the swinging member 301*a* of the lubricant applying device 3 on one side, and FIG. 14 is a cross-sectional view taken along the line B2-B2 in FIG. 12.

In the pressing mechanism 300*c* in the modification, because the portions on which the abutting portions 311 of the swinging members 301*a* slide are the inner periphery surface 32 at the upper portion of the housing case 3*e*, the first electrode members 41 are provided near the both end portions of the inner periphery surface 32 in the longitudinal direction. Furthermore, each of the first electrode members 41 is, as illustrated in FIGS. 13 and 14, arranged being shifted towards the downstream side in the rubbing direction of the applying roller 3*a* on the solid lubricant (moving direction of the surface of the applying roller) with respect to the sliding areas S of the inner periphery surface 32 at the upper portion on which the swinging members 301*a* slide. The first electrode member 41 has a given length in the longitudinal direction so that the first electrode member 41 and the second electrode member 42 can reliably abut each other at the time of a near end of the solid lubricant even when the position of the lubricant retaining member 3*d* is displaced in the longitudinal direction.

Figure 14:
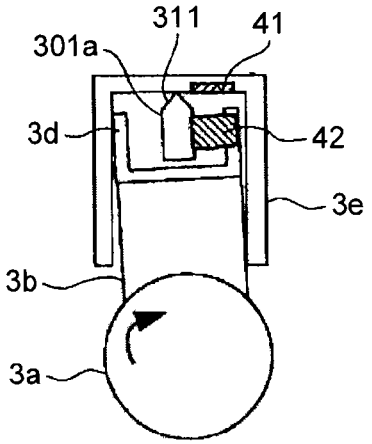
FIG. 14 is a cross-sectional view taken along the line B2-B2 in FIG. 12.

The second electrode member 42 is provided, as illustrated in FIGS. 13 and 14, on the side surface of each of the swinging members 301*a* on the downstream side in the rubbing direction of the applying roller 3*a* on the solid lubricant. Furthermore, the second electrode member 42 is provided, as illustrated in FIG. 12, near the end portion of the swinging side of the swinging member 301*a*.

Figure 15:
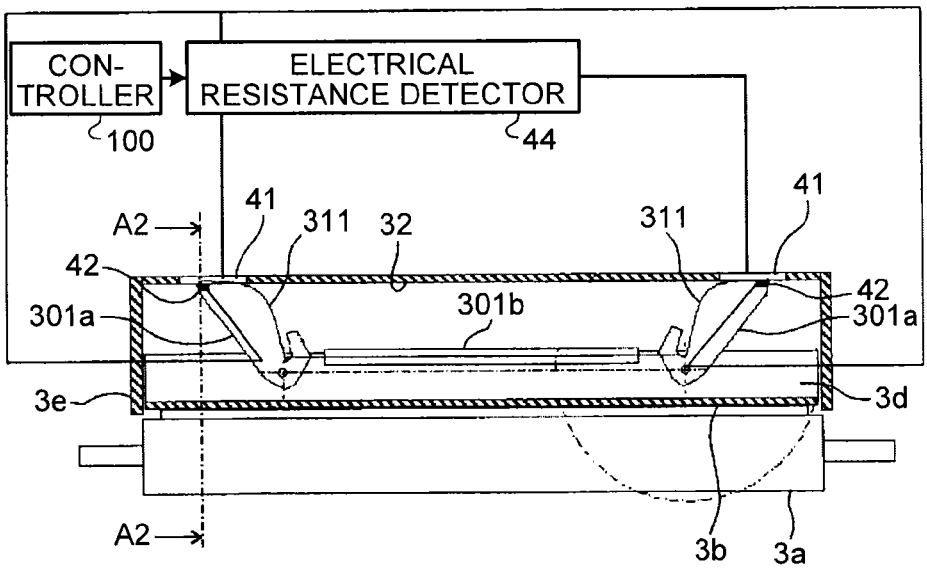
FIG. 15 is a diagram illustrating a solid lubricant in a near-end state in the configuration illustrated in FIG. 12.
Figure 16:
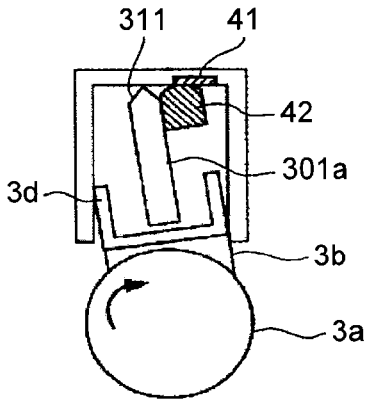
FIG. 16 is a cross-sectional view taken along the line A2-A2 in FIG. 15.

FIG. 15 is a diagram illustrating a near-end state of the solid lubricant 3*b* in the configuration illustrated in FIG. 12, and FIG. 16 is a cross-sectional view taken along the line A2-A2 in FIG. 15.

In the configuration illustrated in FIG. 12, as illustrated in FIG. 14, at the beginning of use, the second electrode members 42 attached to the respective swinging members 301*a* are separated from the first electrode members 41 provided on the lubricant retaining member 3*d*. When the solid lubricant 3*b* is scraped off and the lubricant is consumed, the swinging members 301*a* swing sliding on the inner periphery surface 32 at the upper portion of the housing case 3*e*, and the second electrode members 42 gradually come closer to the first electrode members 41. As illustrated in FIGS. 15 and 16, when the remaining amount of the solid lubricant 3*b* becomes so small (near end), the second electrode members 42 abut the first electrode members 41. When the second electrode members 42 abut the first electrode members 41, the state of the first electrode members 41 and the second electrode members 42 switches from a non-conductive state to a conductive state. Accordingly, when the electrical resistance detector 44 applies a voltage between the first electrode members 41 and the second electrode members 42, a current flows between the first electrode members 41 and the second electrode members 42, whereby a value of electrical resistance is measured by the electrical resistance detector 44.

In the configuration illustrated in FIG. 12, the first electrode members 41 are arranged at positions different from the sliding areas S of the inner periphery surface 32 at the upper portion of the housing case 3*e* on which the swinging members 301*a* slide, and even when the position of the lubricant retaining member 3*d* in use is displaced in the longitudinal direction, the abutting portions 311 of the swinging members 301*a* never slide on the first electrode members 41. As a result, each of the swinging members 301*a* swings in the same manner, whereby the pressing force of the solid lubricant 3*b* to the applying roller 3*a* can be made uniform in the longitudinal direction. Consequently, the amount of lubricant applied to the photosensitive element can be made uniform in the axis direction thereof.

In the configuration illustrated in FIG. 12, as illustrated in FIG. 16, when the upstream side of the lubricant retaining member 3*d* in the moving direction of the surface of the applying roller 3*a* inclines closer to the applying roller 3*a*, the swinging member 301*a*, which is supported by the lubricant retaining member 3*d* to swing freely, swings in the counter-clockwise direction. Accordingly, in the configuration illustrated in FIG. 12, the sliding area of the inner periphery surface 32 at the upper portion of the housing case 3*e* shifts towards the upstream side in the moving direction of the surface of the applying roller 3*a*. However, in the configuration illustrated in FIG. 12, because the first electrode members 41 are arranged being shifted towards the downstream side in the rubbing direction of the applying roller 3*a* on the solid lubricant 3*b* (moving direction of the surface of the applying roller) with respect to the sliding areas S, the abutting portions 311 of the swinging members 301*a* never slide on the first electrode members 41 even when the swinging members 301*a* incline along with the lubricant retaining member 3*d*. Accordingly, each of the swinging members 301*a* can be made to swing in the same manner, whereby the pressing force of the solid lubricant 3*b* to the applying roller 3*a* can be made uniform in the longitudinal direction. Consequently, the amount of lubricant applied to the photosensitive element can be made uniform in the axis direction thereof.

Furthermore, because the swinging member 301*a* inclines in a direction in which the second electrode member 42 comes closer to the first electrode member 41 when the swinging member 301*a* inclines, the second electrode member 42 can be made to abut the first electrode member 41 when the lubricant amount of the solid lubricant comes to a given value or less, whereby the remaining amount of the solid lubricant can be detected.

In the configuration illustrated in FIG. 12, at the time the amount of lubricant is before a near end, the first electrode members 41 and the second electrode members 42 are in a non-conductive state, and thus no current flows even when a voltage is applied between the electrode members. Accordingly, the power is not consumed every time the near-end detection is performed, whereby the reduction in power consumption can be achieved.

As for the near-end detection of the remaining amount detector, it is not restricted to the foregoing, and for example, it may be configured with a push switch substituting the first electrode member 41 and a pressing member substituting the second electrode member 42. In this case, the pressing member attached to the swinging member comes closer to the push switch as a first detecting member along with the rotation of the swinging member, and when the solid lubricant 3*b* becomes a near-end state, the pressing member as a second detecting member presses the push switch, whereby the near end is detected. In this configuration, that arranging the push switch being shifted towards the downstream side in the rubbing direction of the applying roller 3*a* on the solid lubricant 3*b* (moving direction of the surface of the applying roller) with respect to the sliding area S makes the swinging member never press the push switch before the near end, whereby the near end of the solid lubricant can be detected accurately.

Moreover, it can be configured to detect a near end of the solid lubricant 3*b* by a photo sensor. In this case, a transparent window is provided at the position to arrange the first electrode member, and a photo sensor is arranged to face the transparent window. Then, a reflector is arranged at the position to arrange the second electrode member. In this case, when the solid lubricant becomes a near-end state, the reflector attached to the swinging member as a second detecting member faces the transparent window as a first detecting member, and the photo sensor detects the light reflected, whereby the near end of the solid lubricant is detected. In this configuration, that arranging the transparent window being shifted towards the downstream side in the rubbing direction of the applying roller 3*a* on the solid lubricant 3*b* (moving direction of the surface of the applying roller) with respect to the sliding area S allows preventing the swinging member from sliding on the transparent window, whereby the pressing force of the solid lubricant 3*b* to the applying roller 3*a* can be made uniform in the longitudinal direction. Besides the reflective photo sensor (photo reflector), a near end of the solid lubricant can be detected using a transmissive photo sensor (photo interrupter).

Next, modifications in remaining amount detection will be described.

First Modification

Figure 17:
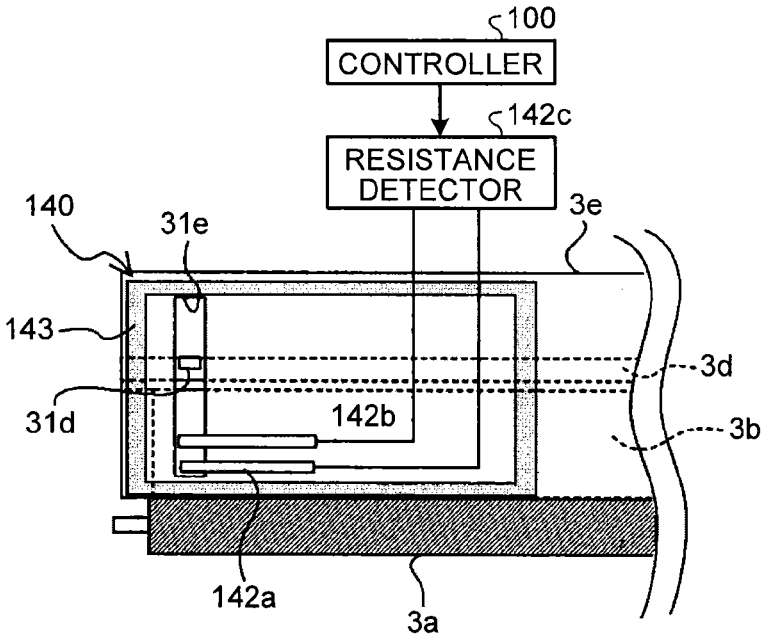
FIG. 17 is a schematic diagram illustrating a configuration of a remaining amount detector according to a first modification.
Figure 18A:
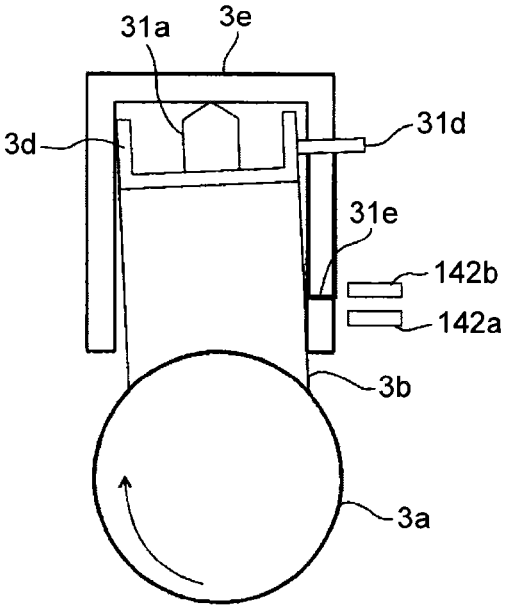
FIGS. 18 A and B are cross-sectional views of the remaining amount detector in the first modification.
Figure 18B:
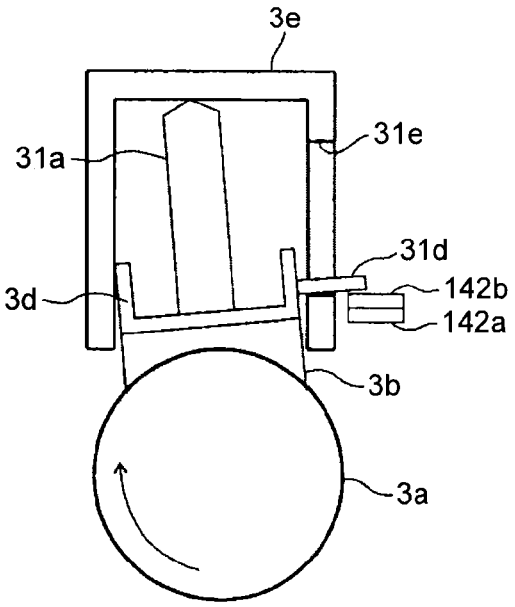
Figure 19:
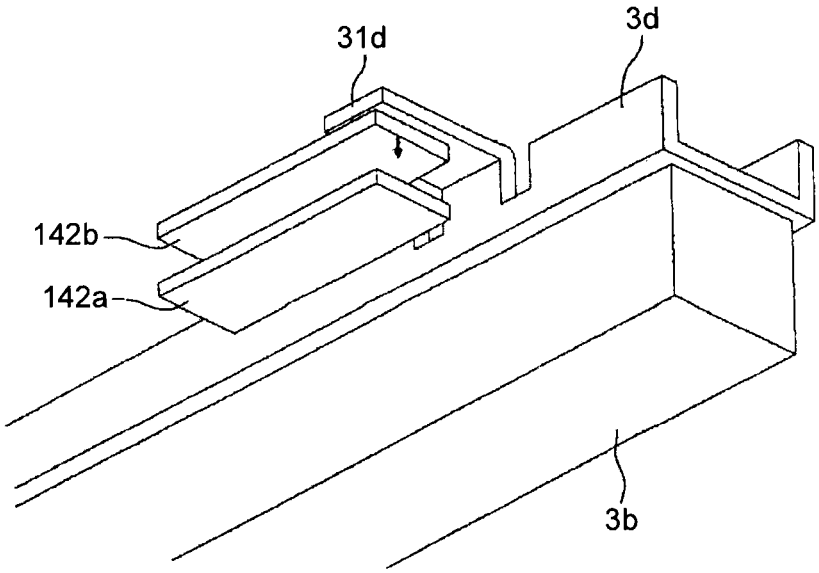
FIG. 19 is a perspective view of a relevant portion of the remaining amount detector in the first modification.

FIG. 17 is a schematic diagram illustrating the configuration of a remaining amount detector 140 according to a first modification, FIGS. 18 A and B are cross-sectional views of the first modification, and FIG. 19 is a perspective view of a relevant portion thereof.

The remaining amount detector 140 in the first modification is provided on a side surface of the housing case 3*e* on the downstream side in the rotational direction of the applying roller than the abutting portion between the applying roller 3*a* and the solid lubricant 3*b*. The remaining amount detector 140 in the first modification includes a first electrode member 142*a*, a second electrode member 142*b* arranged to face the first electrode member 142*a*, a resistance detector 142*c*, and others. The resistance detector 142*c* is connected to the first electrode member 142*a* and the second electrode member 142*b*, and applies a voltage between the first electrode member 142*a* and the second electrode member 142*b* to measure electrical resistance. The resistance detector 142*c* is further connected to the controller 100. The first electrode member 142*a* and the second electrode member 142*b* are positioned and retained by a cover 143 that covers the forgoing.

On the side surface of the housing case 3*e* on the downstream side in the rotational direction of the applying roller than the abutting portion between the applying roller 3*a* and the solid lubricant 3*b*, provided is an opening 31*e* extending in the moving direction of the lubricant retaining member 3*d*. Through the opening 31*e*, penetrating is a pressing portion 31*d* provided on the lubricant retaining member 3*d* as a detected portion.

At the beginning of use, as illustrated in FIG. 18 A, the pressing portion 31*d* provided on the lubricant retaining member 3*d* is separated from the second electrode member 142*b*. Accordingly, in this case, the second electrode member 142*b* is separated from the first electrode member 142*a*, and even when a voltage is applied between the electrode members by the resistance detector 142*c*, no current flows between the electrode members being in a state in which the measurement of a value of electrical resistance is not possible.

When the solid lubricant 3*b* is scraped off and the lubricant is consumed, and thus, the height of the solid lubricant is lowered, the lubricant retaining member 3*d* comes closer towards the applying roller 3*a*. When the height of the solid lubricant 3*b* comes to a given value, the pressing portion 31*d* provided on the lubricant retaining member 3*d* abuts the second electrode member 142*b*. When the solid lubricant 3*b* is further scraped off and the height thereof is lowered, the second electrode member 142*b* is pressed by the pressing portion 31*d*. Thus, the second electrode member 142*b* bends towards the first electrode member 142*a*. Subsequently, as illustrated in FIG. 18 B, when the remaining amount of lubricant becomes so small (near end), a free end of the second electrode member 142*b* abuts the first electrode member 142*a*. When the second electrode member 142*b* abuts the first electrode member 142*a*, the second electrode member 142*b* and the first electrode member 142*a* switch their state from a non-conductive state to a conductive state. This makes a current flow between the electrode members when the resistance detector 142*c* applies a voltage between the first electrode member 142*a* and the second electrode member 142*b*. As a consequence, the resistance detector 142*c* can measure a value of electrical resistance, and the remaining amount of lubricant being so small can be detected.

The remaining amount detector 140 in the first modification is provided on the side surface of the housing case 3*e* on the downstream side in the rotational direction of the applying roller 3*a* than the abutting portion between the applying roller 3*a* and the solid lubricant 3*b*. Therefore, when the solid lubricant 3*b* receives force in the moving direction of the surface of the applying roller 3*a* (left side in FIGS. 18(*a*) and 18(*b*)) at the portion abutting the applying roller 3*a*, the lubricant retaining member 3*d*, which retains the solid lubricant 3*b*, moves in the rubbing direction of the applying roller 3*a* on the solid lubricant (left side in FIGS. 18(*a*) and 18(*b*)), and thus the moving direction of the lubricant retaining member 3*d* becomes the direction to be close to the remaining amount detector 140. Accordingly, the pressing portion 31*d* as a detected portion provided on the lubricant retaining member 3*d* can be made to abut the second electrode member 142*b* reliably. Consequently, a near-end state can be detected reliably. Furthermore, that the lubricant retaining member 3*d* and the solid lubricant 3*b* move in the moving direction of the surface of the applying roller 3*a* (left side in FIGS. 18(*a*) and 18(*b*)) enables the opening 31*e* to be blocked. Therefore, the lubricant powder deposited inside the housing case 3*e* can be prevented from being dispersed from the opening 31*e*.

In the first modification, because the remaining amount detector 140 is provided outside the housing case 3*e*, as compared with when the remaining amount detector is provided inside the housing case 3*e*, the lubricant can be prevented from adhering to the first electrode member 142*a* and the second electrode member 142*b*.

In the first modification, because the remaining amount detector is composed of the first electrode member 142*a* and the second electrode member 142*b* made of sheet metal and such that can be formed at relatively low cost, the remaining amount detector can be constructed inexpensively as compared with when an optical sensor or a push switch is used.

In the first modification, the cover 143 covers the opening 31*e* and the electrode members 142*a* and 142*b*. Accordingly, the lubricant powder can be prevented from being dispersed outside the lubricant applying device 3 from the opening 31*e*, whereby the device can be prevented from getting dirty. Furthermore, the dispersed toner and such can be prevented from adhering to the electrode member 142*a* and the abutting portion of the electrode member 142*a* that is a rotary electrode member, whereby the occurrence of poor electrical conduction between the electrode members can be prevented.

In the first modification, the electrode members 142*a* and 142*b* are positioned and retained by the cover 143. That the electrode member 142*a* and the electrode member 142*b* being positioned and retained by the same member can minimize the component tolerance. Accordingly, the positional relationship of the respective electrode members 142*a* and 142*b* can be made accurately. Consequently, when the solid lubricant 3*b* is in a near-end state, the second electrode member 142*b* can be made to reliably abut the first electrode member 142*a*, whereby the near-end state of lubricant can be detected accurately. In addition, simply removing the cover 143 from the housing case 3*e* can remove the remaining amount detector 40 from the lubricant applying device 3, and thus, the replacement of the remaining amount detector 40 can be made easily.

Figure 20:
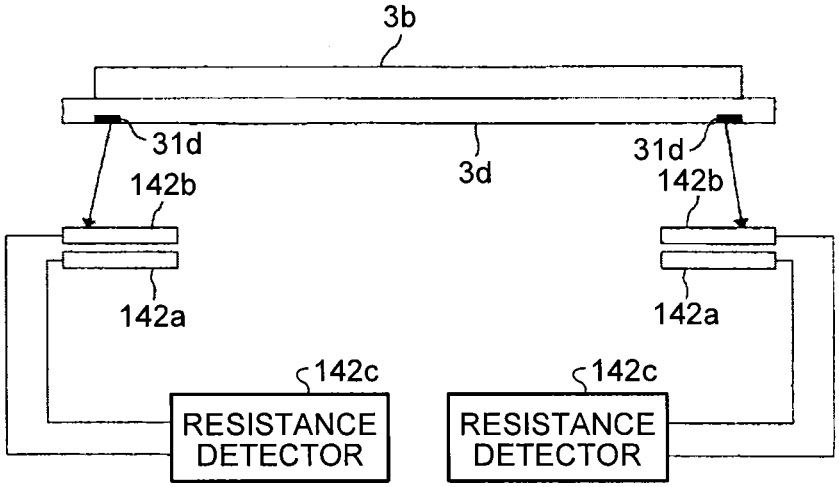
FIG. 20 is a diagram of a resistance detector being provided for respective remaining amount detectors in common.
Figure 21:
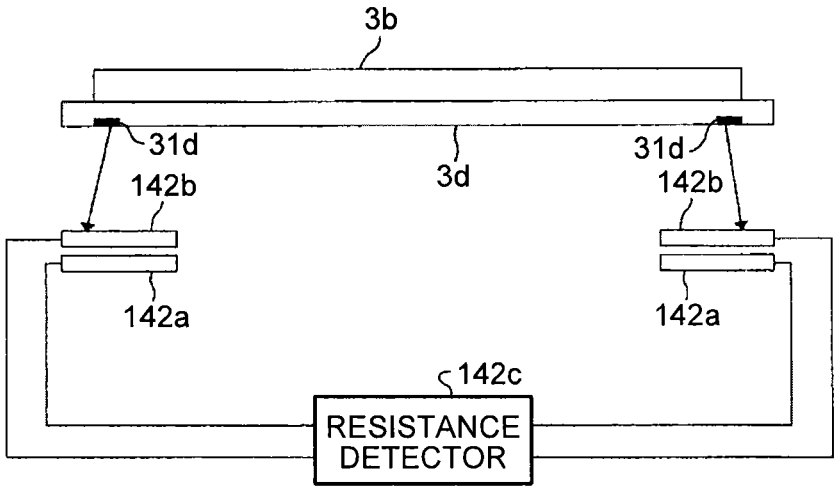
FIG. 21 is a diagram of resistance detectors being provided for respective remaining amount detectors.

In the first modification, the respective remaining amount detecting mechanisms are provided near the both end portions of the solid lubricant 3*b* in the longitudinal direction. Accordingly, even when the consumed amount of lubricant of the solid lubricant 3*b* differs in the longitudinal direction, at the time the end portion on the side the amount of lubricant of which is consumed more comes to a near end, the remaining amount detecting mechanism 40 arranged at the end portion on the side the amount of lubricant of which is consumed more can detect the near end. As illustrated in FIG. 20, the resistance detector 44 may be provided in common to each of the remaining amount mechanisms, or as illustrated in FIG. 21, the resistance detector 44 may be provided to each of the remaining amount detecting mechanisms. As illustrated in FIG. 21, when the resistance detector 44 is provided for each of the remaining amount detecting mechanisms, it can detect which side of the end portion of the solid lubricant in the longitudinal direction came to the near end.

Second Modification

Figure 22:
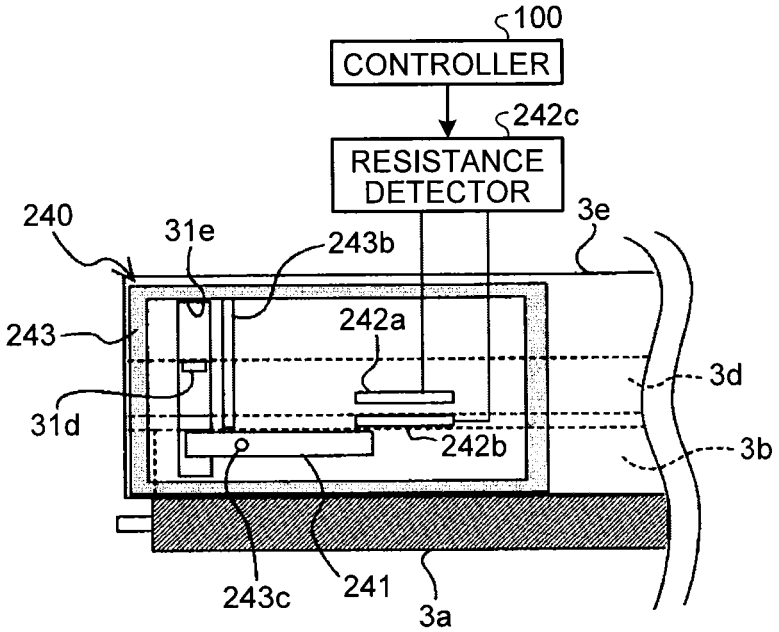
FIG. 22 is a schematic diagram illustrating a configuration of a remaining amount detector according to a second modification.
Figure 22:
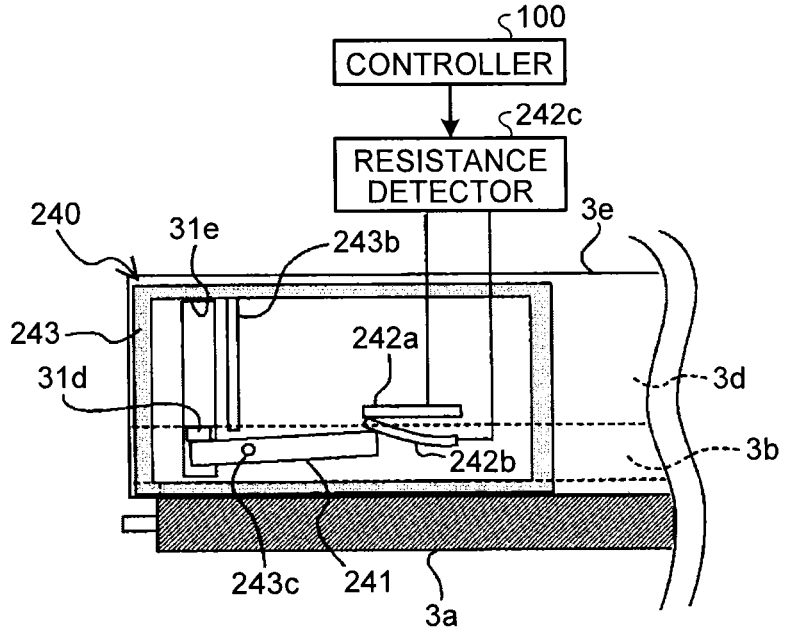
Figure 23:
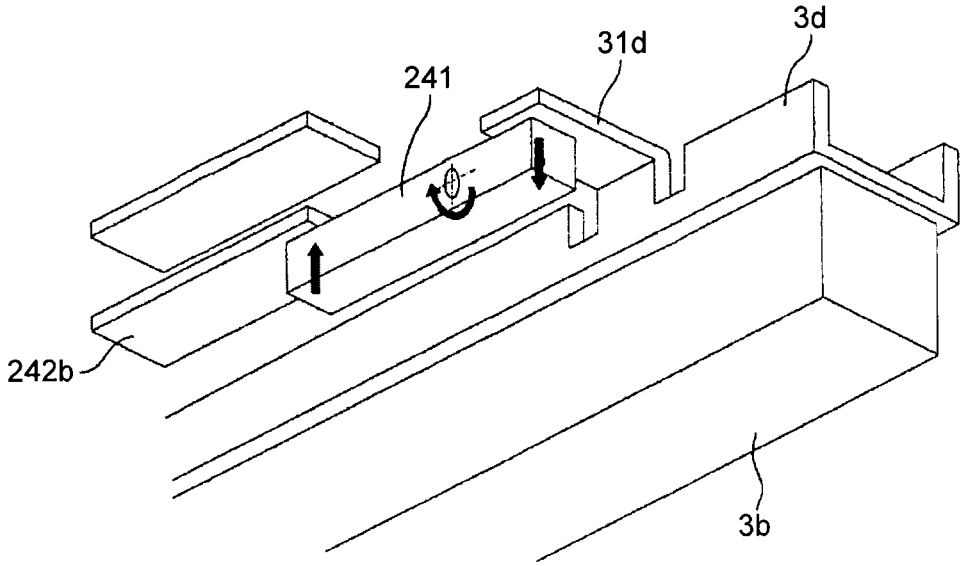
FIG. 23 is a perspective view of a relevant portion of the remaining amount detector in the second modification.

FIG. 22 is a schematic diagram illustrating the configuration of a remaining amount detector 240 according to a second modification, and FIG. 23 is a perspective view of a relevant portion thereof.

The remaining amount detector 240 in the second modification exemplified in FIG. 22 is provided with a detecting rotating member 241. The detecting rotating member 241 is rotatably supported on a rotation shaft 243*c* of a cover 243. The end portion of the detecting rotating member 241 on the left side in FIG. 22 (end portion side of the solid lubricant in the longitudinal direction) faces the pressing portion 31*d* as a detected portion. The end portion of the detecting rotating member 241 on the right side in FIG. 22(*a*) (central side of the solid lubricant in the longitudinal direction) abuts a second electrode member 242*b*.

On the cover 243, a partition wall 243*b* that partitions the space covered with the cover 243 into a space in which the opening 31*e* is arranged and a space in which a first electrode member 242*a* and the second electrode member 242*b* are arranged.

In the second modification, when the solid lubricant 3*b* is scraped off and the lubricant is consumed, and thus, the height of the solid lubricant is lowered, the pressing portion 31*d* abuts the detecting rotating member 241. When the solid lubricant 3*b* is further scraped off and the height thereof is lowered, the end portion of the detecting rotating member 241 on the left side in FIG. 22(*b*) is pressed by the pressing portion 31*d*. Thus, the detecting rotating member 241 rotates in the clockwise direction in FIG. 22(*b*), and the end portion of the detecting rotating member 241 on the right side in FIG. 22(*b*) presses the second electrode member 242*b* towards the first electrode member 242*a*. When it comes to a near end of lubricant, the second electrode member 242*b* abuts the first electrode member 242*a*, whereby the near end is detected.

In the second modification, the first electrode member 242*a* and the second electrode member 242*b* can be provided at positions away from the abutting portion between the solid lubricant 3*b* and the applying roller 3*a*. Accordingly, the lubricant powder scraped off with the applying roller 3*a* can be prevented from adhering to the electrode members. Consequently, the occurrence of poor electrical conduction between the electrode members due to the lubricant adhered to the respective electrode members can be prevented, whereby a near end of the lubricant can be detected accurately.

In the second modification, the partition wall 243*b* partitions the space covered with the cover 243 into the space in which the opening 31*e* is provided and the space in which the respective electrode members are provided. Accordingly, the lubricant powder entered from the opening 31*e* can be further prevented from adhering to the first electrode member 242*a* and the second electrode member 242*b*. It is preferable that the cover 243 and the partition wall 243*b* be formed of resin by integral molding. Accordingly, as compared with when the cover 243 and the partition wall 243*b* are composed of separate components, the number of components can be reduced and the device can be made at low cost. Furthermore, the partition wall 243*b* may be provided on the housing case 3*e*. In this case, that the housing case 3*e* and the partition wall 243*b* being formed of resin by integral molding allows reducing the number of components, whereby the device can be made at low cost. Moreover, by providing the respective partition walls on the cover 243 and on the housing case 3*e* and by combining them together, the space covered with the cover 243 may be partitioned into the space in which the opening 31*e* is provided and the space in which the respective electrode members are provided.

Depending on the configuration of the apparatus, there may be a case in which the remaining amount detector cannot be provided on the downstream side in the rotational direction of the applying roller than the abutting portion between the applying roller 3*a* and the solid lubricant 3*b* at the time of image forming. In an image forming apparatus, typically, the photosensitive element is rotated in reverse at the end of image forming operation to break away the toner held back on the cleaning blade and to remove the toner from the cleaning blade. At this time, by also rotating the applying roller 3*a* in reverse, the detection of remaining amount of lubricant is performed. Accordingly, when detecting the remaining amount of lubricant, the remaining amount detector is on the downstream side in the rotational direction of the applying roller than the abutting portion between the applying roller 3*a* and the solid lubricant 3*b* at the time of image forming. As a consequence, as in the foregoing, the remaining amount of lubricant can be detected reliably.

Furthermore, the above-described lubricant applying device may be applied to the lubricant applying device that applies lubricant to the intermediate transfer belt 56.

The descriptions made above are mere examples, and the embodiment has specific effects in each of the following aspects (1) to (11).

(1) The lubricant applying device 3 includes the solid lubricant 3*b*, a supplying member such as the applying roller 3*a* that supplies lubricant of the solid lubricant 3*b* to a lubricant supplying target such as the photosensitive element 1, a remaining amount detecting unit such as the remaining amount detector 40 that detects the amount of the solid lubricant 3*b* being at a given amount or less, and the remaining amount detecting unit is provided on the downstream side in the rubbing direction of the supplying member with respect to the solid lubricant.

Having such a configuration allows, as described in the embodiment, detecting a near end of the lubricant reliably.

(2) In the lubricant applying device 3 described in the above-descried aspect (1), the remaining amount detecting unit such as the remaining amount detector 40 detects a detected portion such as the pressing portion 31*d* that moves along with consumption of the solid lubricant coming to a given position to detect the remaining amount of the solid lubricant being at a given amount or less.

Having such a configuration allows, as described in the embodiment, detecting a near end of the solid lubricant.

(3) In the lubricant applying device 3 described in the above-descried aspect (2), the housing case 3*e* that houses the solid lubricant 3*b* is further provided, and the remaining amount detecting unit is provided outside the housing case 3*e*.

Having such a configuration allows, as described in the first modification, compared with when provided inside the housing case 3*e*, preventing the lubricant from adhering to the remaining amount detector, whereby an erroneous detection can be prevented.

(4) In the lubricant applying device 3 described in the above-descried aspect (3), the housing case 3*e* has the opening 31*e* through which the detected portion such as the pressing portion 31*d* penetrates, and the cover 143 is provided that covers the remaining amount detecting unit and the opening 31*e*.

Having such a configuration allows, as described in the first modification, preventing the lubricant powder from being dispersed from the opening 31*e* to the outside of the lubricant applying device 3, whereby the device can be prevented from getting dirty. Furthermore, the dispersed toner and such can be prevented from adhering to the remaining amount detector, whereby an erroneous detection can be prevented.

(5) In the lubricant applying device 3 described in any one of the above-descried aspects (2) to (4), the remaining amount detecting unit such as the remaining amount detector includes a first electrode member and a second electrode member that abuts the first electrode member by being pressed towards the first electrode member directly or indirectly by the detected portion such as the pressing portion 31*d*, and electrical conduction between the first electrode member and the second electrode member is detected to detect that the remaining amount of the solid lubricant is at a given amount or less.

Having such a configuration allows, as described in the first modification, constructing the remaining amount detector at low cost.

(6) In the lubricant applying device 3 described in the above-descried aspect (5), the remaining amount detecting unit such as a remaining amount detector includes the rotating member 241 provided to be rotatable and the detected portion such as the pressing portion 31*d* that presses the rotating member 241 along with the consumption of the solid lubricant 3*b*, and the rotating member 241 on the side opposite to a portion abutting the detected portion across the rotation fulcrum of the rotating member 241 abuts a second electrode member 241*b*.

Having such a configuration allows, as described in the second modification, arranging a first electrode member 42*a* and a second electrode member 42*b* at positions away from the opening 31*e*. Accordingly, the lubricant can be prevented from adhering to the first electrode member 42*a* and the second electrode member 42*b*.

(7) In the lubricant supplying device described in any one of the above-descried aspects (2) to (6), the detected portion is a projecting portion such as the pressing portion 31*d* provided on a lubricant retaining member that retains the solid lubricant.

Having such a configuration allows moving the detecting portion along with the consumption of the solid lubricant.

(8) In the lubricant applying device 3 described in the above-descried aspect (2), further included are a pair of swinging members 31*a* that is supported by the housing case 3*e* that houses the solid lubricant 3*b* to swing freely and swings while sliding on the lubricant retaining member 3*d* that retains the solid lubricant 3*b* or that is supported by the lubricant retaining member 3*d* to swing freely and swings while sliding on a facing surface of the housing case 3*e* that faces the lubricant retaining member 3*d*, a biasing unit 31*b* that biases the pair of swinging members 31*a*, and the pressing mechanism 3*c* in which the swinging members 31*a* swing while sliding on the inner periphery surface of the housing case 3*e* or on the lubricant retaining member 3*d* by the biasing force of the biasing unit 31*b* to press the solid lubricant 3*b* to the supplying member such as the applying roller 3*a*, and the remaining amount detecting unit detects the detected portions attached to the swinging members 31*a*.

In such a configuration, as described in the embodiment, the remaining amount detector can detect the detected portions when the amount of the solid lubricant comes to a given amount or less.

(9) In the lubricant supplying device described in the above-descried aspect (8), the first detecting member and the second detecting member are electrode members and are configured such that the first detecting member and the second detecting member abut each other when the length of the solid lubricant 3*b* in the moving direction and on the upstream side in a rubbing direction of the supplying member with respect to the solid lubricant 3*b* comes to the given value, and the remaining amount detecting unit applies a voltage between the first detecting member and the second detecting member and detects a connecting condition between the electrodes to detect the remaining amount of the solid lubricant.

Having such a configuration allows reducing the power consumption, as compared with when the detection is made while being conductive from the beginning of use, because the first detecting member 41 and the second detecting member 42 abut each other and become conductive only when the remaining amount of lubricant becomes so small.

(10) In an image forming apparatus that includes an image carrier such as the photosensitive element 1 and a lubricant supplying unit that supplies lubricant to the surface of the image carrier, and that eventually transfers an image on the image carrier onto a recording material to form an image on the recording material, the lubricant supplying device described in any one of the above-described aspects (1) to (9) is used as the lubricant supplying unit.

Having such a configuration allows detecting a near end of the lubricant favorably, and thus, image forming operation can be prevented from being performed while the lubricant is exhausted. Accordingly, the deterioration of photosensitive element can be prevented over time.

(11) In a process cartridge that includes an image carrier such as the photosensitive element 1 and a lubricant supplying unit that supplies lubricant to the surface of the image carrier, and that is configured to be detachably attached to a body of an image forming apparatus, the lubricant supplying device described in any one of the above-described aspects (1) to (9) is used as the lubricant supplying unit.

Having such a configuration allows detecting a near end of the lubricant favorably, and thus, image forming operation can be prevented from being performed while the lubricant is exhausted. Accordingly, provided can be a process cartridge that can prevent the deterioration of photosensitive element over time.

The embodiment can prevent an erroneous detection of the remaining amount detecting unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant supplying device comprising:

a solid lubricant;

a supplying member that supplies lubricant of the solid lubricant to a lubricant supplying target;

a pressing member that presses the solid lubricant onto the supplying member; and a remaining amount detecting unit that detects an amount of the solid lubricant, wherein the remaining amount detecting unit is provided entirely on a downstream side in a rotational direction of the supplying member with respect to the pressing member.

2. The lubricant supplying device according to claim 1, wherein the remaining amount detecting unit detects a detected portion that moves along with consumption of the solid lubricant coming to a given position so as to detect a remaining amount of the solid lubricant being at a given amount or less.

3. The lubricant supplying device according to claim 2, further comprising:

a housing case that houses the solid lubricant, wherein the remaining amount detecting unit is provided outside the housing case.

4. The lubricant supplying device according to claim 3, wherein the housing case has an opening through which the detected portion penetrates, and a cover is provided that covers the remaining amount detecting unit and the opening.

5. The lubricant supplying device according to claim 2, wherein: the remaining amount detecting unit includes:

a first electrode member, and a second electrode member that abuts the first electrode member by being pressed towards the first electrode member directly or indirectly by the detected portion; and an electrical conduction between the first electrode member and the second electrode member is detected so as to detect that the remaining amount of the solid lubricant is at the given amount or less.

6. The lubricant supplying device according to claim 5, wherein: the remaining amount detecting unit includes a rotating member provided to be rotatable, the detected portion presses the rotating member along with consumption of the solid lubricant, and the first electrode member abuts the second electrode member at an opposite side of an abutting position of the rotating member and the detected portion across a rotational fulcrum of the rotating member.

7. The lubricant supplying device according to claim 2, wherein the detected portion is a projecting portion provided on a lubricant retaining member that retains the solid lubricant.

8. The lubricant supplying device according to claim 2, further comprising:

a pair of swinging members that is supported by a housing case that houses the solid lubricant to swing freely and swings while sliding on a lubricant retaining member that retains the solid lubricant, or that is supported by the lubricant retaining member to swing freely and swings while sliding on a surface of the housing case that is opposite to the lubricant retaining member;

a biasing unit that biases the pair of swinging members; and a pressing mechanism in which the swinging members provide the pressing member and swing while sliding on an inner periphery surface of the housing case or on the lubricant retaining member by a biasing force of the biasing unit so as to press the solid lubricant onto the supplying member, wherein the remaining amount detecting unit detects the detected portion that is attached to the swinging members.

9. The lubricant supplying device according to claim 8, wherein the remaining amount detecting unit includes an electrode member that abuts a conductive detected portion when the solid lubricant is at the given amount or less, and an electrical conduction between the electrode member and the conductive detected portion is detected so as to detect that a remaining amount of the solid lubricant is at the given amount or less.

10. An image forming apparatus comprising:

an image carrier; and a lubricant supplying unit that supplies lubricant to a surface of the image carrier, wherein:

the image forming apparatus transfers an image on the image carrier onto a recording material to form an image on the recording material, and the lubricant supplying unit is the lubricant supplying device according to claim 1.

11. A process cartridge comprising:

an image carrier; and a lubricant supplying unit that supplies lubricant to a surface of the image carrier, wherein:

the process cartridge is configured to be detachably attached to a body of an image forming apparatus, and the lubricant supplying unit is the lubricant supplying device according to claim 1.

12. A lubricant supplying device comprising:

a solid lubricant;

a supplying member that supplies lubricant of the solid lubricant to a lubricant supplying target;

a pressing member that presses the solid lubricant onto the supplying member; and a detector that detects an amount of the solid lubricant at a downstream side in a rotational direction of the supplying member with respect to the pressing member.

13. The lubricant supplying device according to claim 12, further comprising:

a remaining amount detecting unit including:

a first electrode member, and a second electrode member that abuts the first electrode member by being pressed towards the first electrode member directly or indirectly by a detected portion; and an electrical conduction between the first electrode member and the second electrode member is detected so as to detect that a remaining amount of the solid lubricant is at a given amount or less.

14. The lubricant supplying device according to claim 12, further comprising:

a remaining amount detecting unit including a rotating member provided to be rotatable, a detected portion presses the rotating member along with consumption of the solid lubricant, and a first electrode member abuts a second electrode member at an opposite side of an abutting position of the rotating member and the detected portion across a rotational fulcrum of the rotating member.

15. The lubricant supplying device according to claim 12, wherein:

the detector includes a first electrode member, and a second electrode member that abuts the first electrode member by being pressed towards the first electrode member directly or indirectly by a detected portion; and the detected portion is at the downstream side in the rotational direction of the supplying member with respect to the pressing member.

16. The lubricant supplying device according to claim 15, wherein the detected portion is a projecting portion at a lubricant retaining member that retains the solid lubricant.

17. The lubricant supplying device according to claim 15, wherein:

the detector includes a rotating member that is to be pressed by the detected portion; and the first electrode member abuts the second electrode member by contacting the rotating member.

18. The lubricant supplying device according to claim 16, wherein the rotating member rotates in a direction intersecting the rotational direction of the supplying member.

19. An image forming apparatus comprising:

an image carrier; and a lubricant supplying unit that supplies lubricant to a surface of the image carrier, wherein:

the image forming apparatus transfers an image on the image carrier onto a recording material to form an image on the recording material, and the lubricant supplying unit is the lubricant supplying device according to claim 12.

20. A process cartridge comprising:

an image carrier; and a lubricant supplying unit that supplies lubricant to a surface of the image carrier, wherein:

the process cartridge is configured to be detachably attached to a body of an image forming apparatus, and the lubricant supplying unit is the lubricant supplying device according to claim 12.

* * * * *